US010869156B2

(12) United States Patent
Lehtiniemi et al.

(10) Patent No.: US 10,869,156 B2
(45) Date of Patent: Dec. 15, 2020

(54) AUDIO PROCESSING

(71) Applicant: Nokia Technologies Oy, Espoo (FI)

(72) Inventors: Arto Lehtiniemi, Lempäälä (FI); Antti Eronen, Tampere (FI); Jussi Leppänen, Tampere (FI); Juha Arrasvuori, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 36 days.

(21) Appl. No.: 16/330,273

(22) PCT Filed: Sep. 7, 2017

(86) PCT No.: PCT/FI2017/050630

§ 371 (c)(1),
(2) Date: Mar. 4, 2019

(87) PCT Pub. No.: WO2018/050959

PCT Pub. Date: Mar. 22, 2018

(65) Prior Publication Data

US 2019/0191264 A1 Jun. 20, 2019

(30) Foreign Application Priority Data

Sep. 13, 2016 (EP) ..... 16188437

(51) Int. Cl.
*H04S 7/00* (2006.01)

(52) U.S. Cl.
CPC ..... *H04S 7/40* (2013.01); *H04S 7/30* (2013.01); *H04S 2400/11* (2013.01)

(58) Field of Classification Search
None
See application file for complete search history.

(56) References Cited

U.S. PATENT DOCUMENTS

| | | | | |
|---|---|---|---|---|
| 8,861,926 | B2 | 10/2014 | Hunt et al. | |
| 2015/0098584 | A1 | 4/2015 | Emani et al. | |
| 2016/0050508 | A1 | 2/2016 | Redmann | |
| 2016/0133263 | A1* | 5/2016 | Borss | H04S 3/02 381/22 |
| 2016/0142851 | A1 | 5/2016 | Sun et al. | |

(Continued)

FOREIGN PATENT DOCUMENTS

| | | | |
|---|---|---|---|
| CN | 104244164 | A | 12/2014 |
| CN | 105340299 | A | 2/2016 |

(Continued)

OTHER PUBLICATIONS

Office action received for corresponding European Patent Application No. 16188437.4, dated Mar. 28, 2019, 4 pages.

(Continued)

*Primary Examiner* — Paul W Huber
(74) *Attorney, Agent, or Firm* — Alston & Bird LLP

(57) ABSTRACT

A method comprising: causing display of a sound-source virtual visual object in a three-dimensional virtual visual space; causing display of a multiplicity of interconnecting virtual visual objects in the three-dimensional virtual visual space, wherein at least some of the multiplicity of interconnecting virtual visual objects interconnect visually a sound-source virtual visual object and a user-controlled virtual visual object, wherein a visual appearance of each interconnecting virtual visual object, is dependent up on one or more characteristics of a sound object associated with the sound-source virtual visual object to which the interconnecting virtual visual object is interconnected, and wherein audio processing of the sound objects to produce rendered sound objects depends on user-interaction with the user-controlled virtual visual object and user-controlled interconnection of interconnecting virtual visual objects between sound-source virtual visual objects and the user-controlled virtual visual object.

19 Claims, 9 Drawing Sheets

(56) References Cited

U.S. PATENT DOCUMENTS

| | | | | |
|---|---|---|---|---|
| 2016/0225377 | A1* | 8/2016 | Miyasaka | G10L 19/008 |
| 2016/0255453 | A1 | 9/2016 | Fueg et al. | |
| 2018/0167756 | A1* | 6/2018 | Mateos Sole | H04S 7/30 |

FOREIGN PATENT DOCUMENTS

| | | | |
|---|---|---|---|
| CN | 105519139 | A | 4/2016 |
| EP | 1511351 | A2 | 3/2005 |
| EP | 2891955 | A1 | 7/2015 |
| EP | 3 005 733 | A1 | 4/2016 |
| WO | 2006/059957 | A1 | 6/2006 |
| WO | WO 2014/193993 | A1 | 12/2014 |

OTHER PUBLICATIONS

Smith., "Idea-Generation Techniques: A Formulary of Active Ingredients", Journal of creative behavior, vol. 32, No. 2, Jun. 1998, pp. 107-133.

Shah et al., "Metrics for Measuring Ideation Effectiveness", Design Studies, vol. 24, No. 2, Mar. 2003, pp. 111-134.

Smith, "Towards a logic of innovation", The International Handbook on Innovation, Dec. 2003. p. 347-365.

"Match Cut", Wikipedia, Retrieved on Feb. 22, 2019, Webpage available at : https://en.wikipedia.org/wiki/Match_cut.

Extended European Search Report received for corresponding European Patent Application No. 16188437.4, dated Mar. 6, 2017, 8 pages.

International Search Report and Written Opinion received for corresponding Patent Cooperation Treaty Application No. PCT/FI2017/050630, dated Nov. 6, 2017, 11 pages.

Office action received for corresponding European Patent Application No. 16188437.4, dated Oct. 11, 2018, 5 pages.

Office action received for corresponding European Patent Application No. 16188437.4, dated Aug. 14, 2019, 5 pages.

Office Action for Chinese Application No. 201780056011.3 dated Jul. 28, 2020, 10 pages.

* cited by examiner

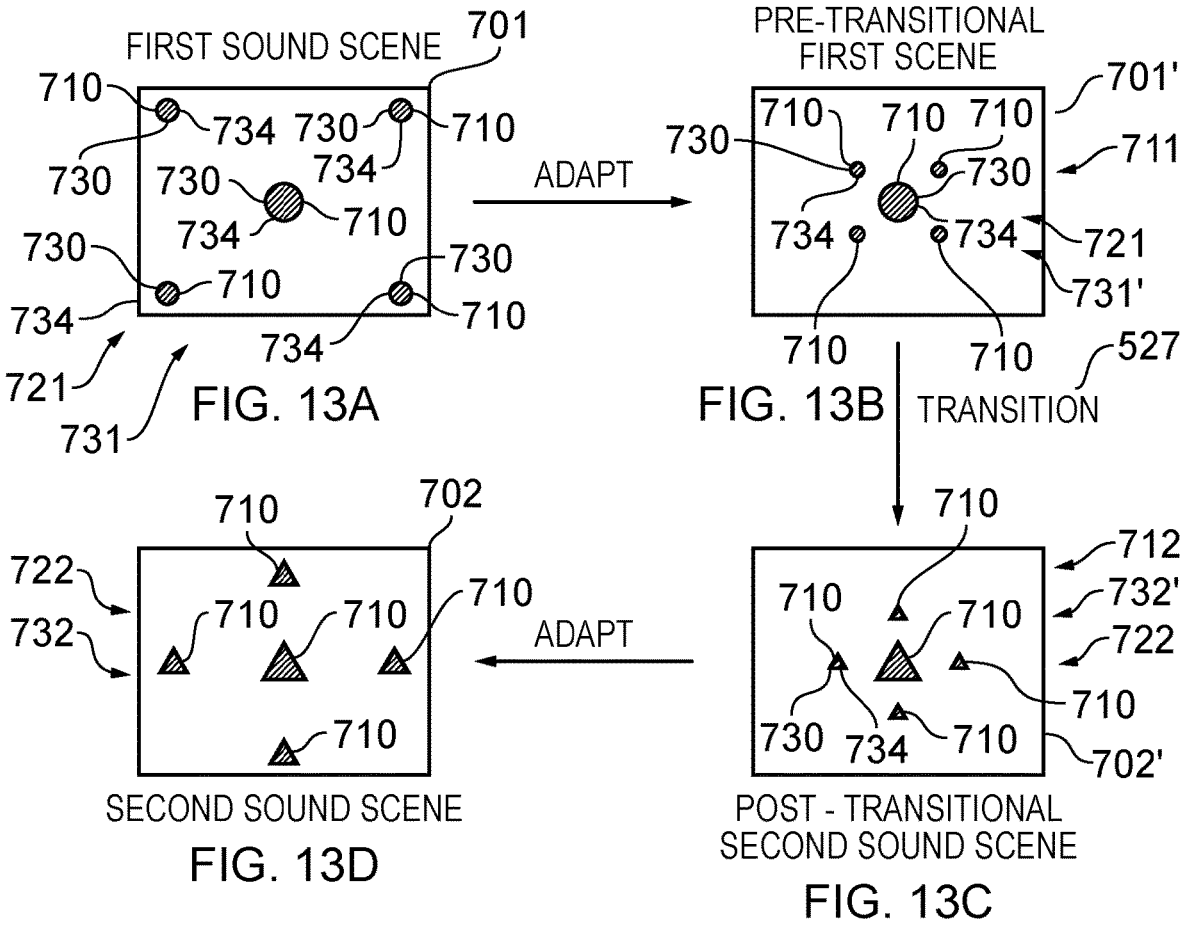
FIRST SOUND SCENE
701
710
734
730
710
730
734
730
730
734
710
730
710
734
710
721
731
FIG. 13A
ADAPT
PRE-TRANSITIONAL
FIRST SCENE
701'
710
710
710
730
711
730
734
734
721
731'
710
710
FIG. 13B
527
TRANSITION
710
712
710
710
732'
722
710
730
734
710
702'
POST - TRANSITIONAL
SECOND SOUND SCENE
FIG. 13C
ADAPT
710
702
722
710
710
710
732
710
SECOND SOUND SCENE
FIG. 13D
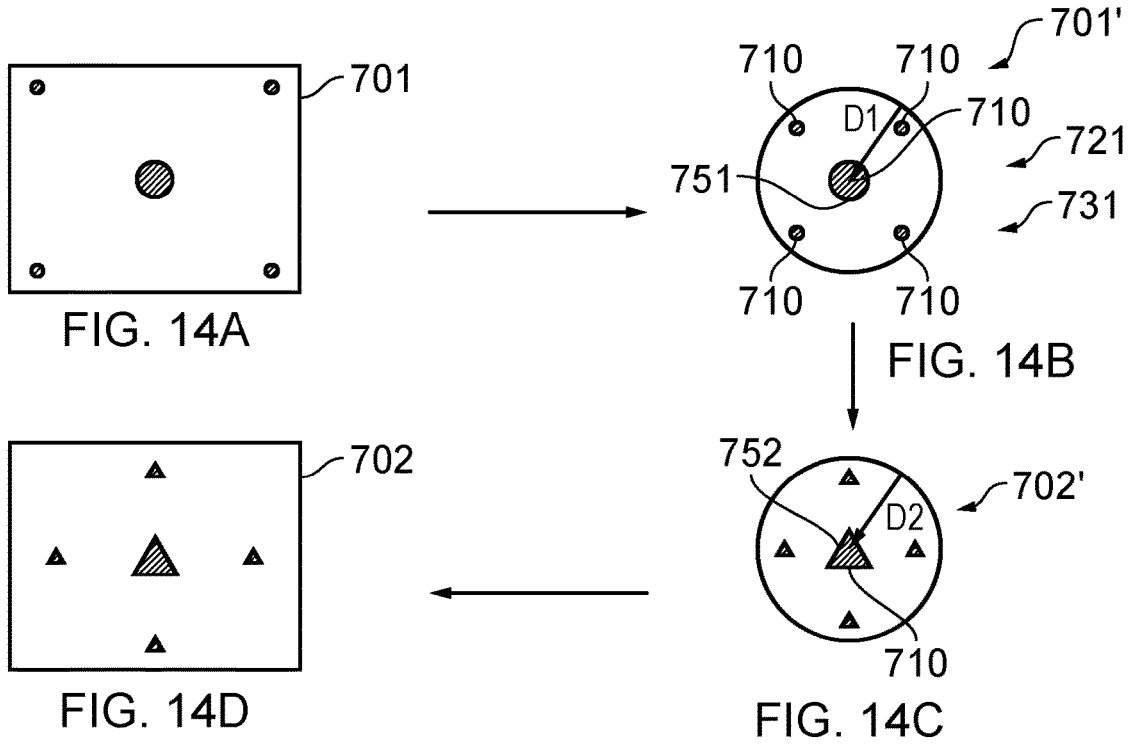
701
FIG. 14A
701'
710
710
D1
710
721
751
731
710
710
FIG. 14B
752
702'
D2
710
FIG. 14C
702
FIG. 14D

AUDIO PROCESSING

RELATED APPLICATION

This application was originally filed as Patent Cooperation Treaty Application No. PCT/FI2017/050630 filed Sep. 7, 2017 which claims priority benefit to EP Patent Application No. 16188437.4, filed Sep. 13, 2016.

TECHNOLOGICAL FIELD

Embodiments of the present invention relate to audio processing. Some but not necessarily all examples relate to automatic control of audio processing.

BACKGROUND

Spatial audio rendering comprises rendering sound scenes comprising sound objects at respective positions.

Each sound scene therefore comprises a significant amount of information that is processed aurally by a listener. The user will appreciate not only the presence of a sound object but also its location in the sound scene and relative to other sound objects.

BRIEF SUMMARY

According to various, but not necessarily all, embodiments of the invention there is provided a method comprising: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions, by:

- causing rendering of the first sound scene comprising the first set of sound objects at the first set of respective positions; then
- causing changing of the respective positions of at least some of the first set of sound objects to render the first sound scene in a pre-transitional phase as an adapted first sound scene comprising the first set of sound objects at a first adapted set of respective positions different to the first set of respective positions; then
- causing rendering of the second sound scene in a post-transitional phase as an adapted second sound scene comprising the second set of sound objects at a second adapted set of respective positions different to the second set of respective positions; then
- causing a changing of the respective positions of at least some of the second set of sound objects to render the second sound scene as the second set of sound objects at the second set of respective positions.

According to various, but not necessarily all, embodiments of the invention there is provided a method comprising: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising either at least some of the first set of sound objects at a first adapted set of respective positions different to the first set of respective positions or at least some of the second set of sound objects at a second adapted set of respective positions different to the second set of respective positions.

According to various, but not necessarily all, embodiments of the invention there is provided a method comprising: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising at least some of the first set of sound objects at a first adapted set of respective positions different to the first set of respective positions and comprising none of the second set of sound objects.

According to various, but not necessarily all, embodiments of the invention there is provided a method comprising: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising at least some of the second set of sound objects at a second adapted set of respective positions different to the second set of respective positions and comprising none of the first set of sound objects.

According to various, but not necessarily all, embodiments of the invention there is provided examples as claimed in the appended claims.

The impact on a user that occurs when one sound scene transitions to another sound scene is therefore lessened.

BRIEF DESCRIPTION

For a better understanding of various examples that are useful for understanding the brief description, reference will now be made by way of example only to the accompanying drawings in which:

FIGS. 1A-1C and 2A-2C illustrate examples of mediated reality in which FIGS. 1A, 1B, 1C illustrate the same virtual visual space and different points of view and FIGS. 2A, 2B, 2C illustrate a virtual visual scene from the perspective of the respective points of view;

FIGS. 13A-13D illustrate an example of an indirect transition from a first sound scene (FIG. 13A) to a second sound scene (FIG. 13D) via at least one intermediate sound scene, for example, a pre-transitional phase of the first sound scene (FIG. 13B) and/or a post-transitional phase of the second sound scene (FIG. 13C);

FIGS. 14A-14D illustrate another example of an indirect transition from a first sound scene (FIG. 14A) to a second sound scene (FIG. 14D) via at least one intermediate sound scene, for example, a pre-transitional phase of the first sound scene (FIG. 14B) and/or a post-transitional phase of the second sound scene (FIG. 14C);

DEFINITIONS

Figure 1A:
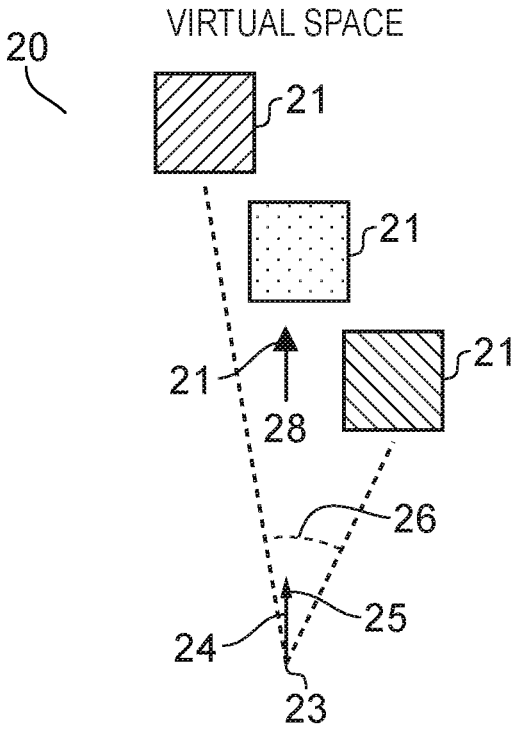

"artificial environment" is something that has been recorded or generated.

"virtual visual space" refers to fully or partially artificial environment that may be viewed, which may be three dimensional.

"virtual visual scene" refers to a representation of the virtual visual space viewed from a particular point of view within the virtual visual space.

'virtual visual object' is a visible virtual object within a virtual visual scene.

"real space" refers to a real environment, which may be three dimensional.

"real visual scene" refers to a representation of the real space viewed from a particular point of view within the real space.

"mediated reality" in this document refers to a user visually experiencing a fully or partially artificial environment (a virtual visual space) as a virtual visual scene at least partially displayed by an apparatus to a user. The virtual visual scene is determined by a point of view within the virtual visual space and a field of view. Displaying the virtual visual scene means providing it in a form that can be seen by the user.

"augmented reality" in this document refers to a form of mediated reality in which a user visually experiences a partially artificial environment (a virtual visual space) as a virtual visual scene comprising a real visual scene of a physical real world environment (real space) supplemented by one or more visual elements displayed by an apparatus to a user;

"virtual reality" in this document refers to a form of mediated reality in which a user visually experiences a fully artificial environment (a virtual visual space) as a virtual visual scene displayed by an apparatus to a user;

"perspective-mediated" as applied to mediated reality, augmented reality or virtual reality means that user actions determine the point of view within the virtual visual space, changing the virtual visual scene;

"first person perspective-mediated" as applied to mediated reality, augmented reality or virtual reality means perspective mediated with the additional constraint that the user's real point of view determines the point of view within the virtual visual space;

"third person perspective-mediated" as applied to mediated reality, augmented reality or virtual reality means perspective mediated with the additional constraint that the user's real point of view does not determine the point of view within the virtual visual space;

"user interactive" as applied to mediated reality, augmented reality or virtual reality means that user actions at least partially determine what happens within the virtual visual space;

"displaying" means providing in a form that is perceived visually (viewed) by the user.

"rendering" means providing in a form that is perceived by the user

"sound space" refers to an arrangement of sound sources in a three-dimensional space. A sound space may be defined in relation to recording sounds (a recorded sound space) and in relation to rendering sounds (a rendered sound space).

"sound scene" refers to a representation of the sound space listened to from a particular point of view within the sound space.

"sound object" refers to sound that may be located within the sound space. A source sound object represents a sound source within the sound space. A recorded sound object represents sounds recorded at a particular microphone or position. A rendered sound object represents sounds rendered from a particular position.

"Correspondence" or "corresponding" when used in relation to a sound space and a virtual visual space means that the sound space and virtual visual space are time and space aligned, that is they are the same space at the same time.

"Correspondence" or "corresponding" when used in relation to a sound scene and a virtual visual scene (or visual scene) means that the sound space and virtual visual space (or visual scene) are corresponding and a notional listener whose point of view defines the sound scene and a notional viewer whose point of view defines the virtual visual scene (or visual scene) are at the same position and orientation, that is they have the same point of view.

"virtual space" may mean a virtual visual space, mean a sound space or mean a combination of a virtual visual space and corresponding sound space.

"virtual scene" may mean a virtual visual scene, mean a sound scene or mean a combination of a virtual visual scene and corresponding sound scene.

'virtual object' is an object within a virtual scene, it may be an artificial virtual object (e.g. a computer-generated virtual object) or it may be an image of a real object in a real space that is live or recorded. It may be a sound object and/or a virtual visual object.

Description

FIGS. 1A-1C and 2A-2C illustrate examples of mediated reality. The mediated reality may be augmented reality or virtual reality.

Figure 1B:
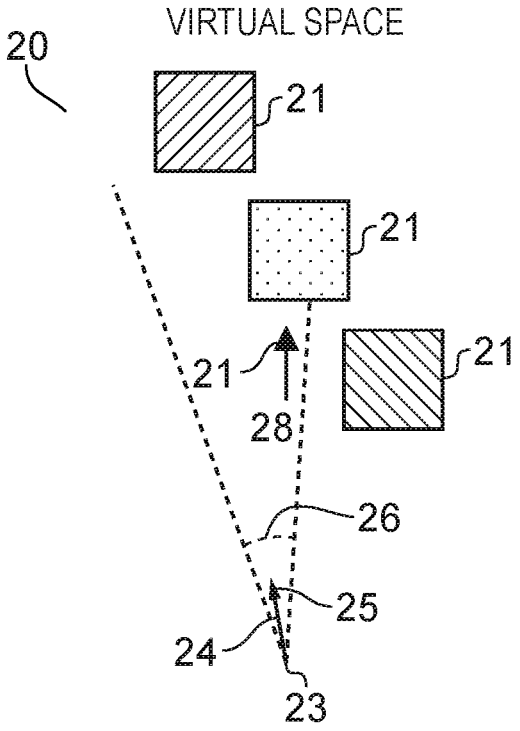
Figure 1C:
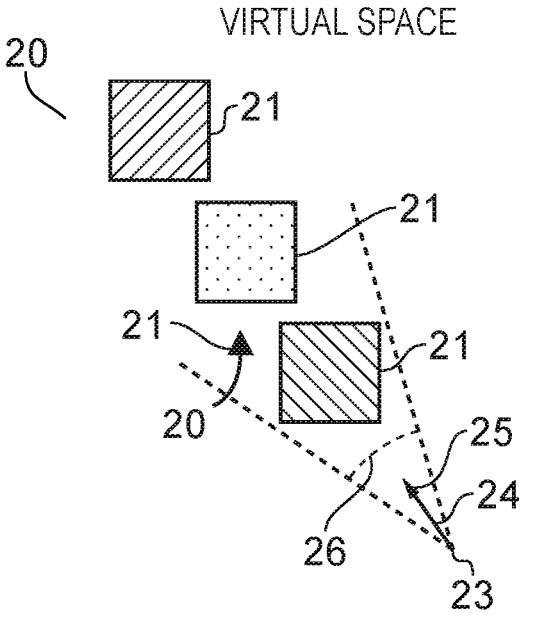

FIGS. 1A, 1B, 1C illustrate the same virtual visual space 20 comprising the same virtual visual objects 21, however, each Fig illustrates a different point of view 24. The position and direction of a point of view 24 can change independently. The direction but not the position of the point of view 24 changes from FIG. 1A to FIG. 1B. The direction and the position of the point of view 24 changes from FIG. 1B to FIG. 1C.

Figure 2A:
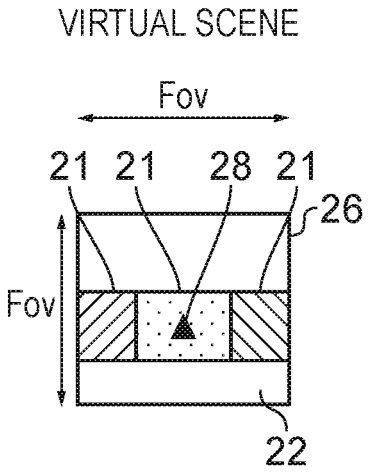
Figure 2B:
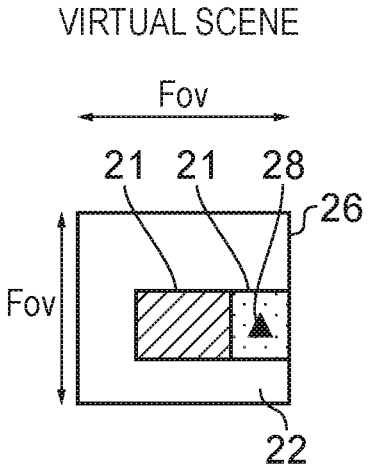
Figure 2C:
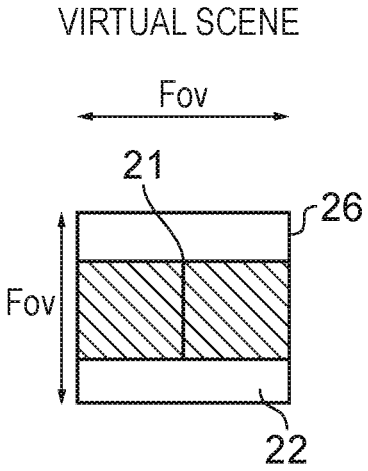

FIGS. 2A, 2B, 2C illustrate a virtual visual scene 22 from the perspective of the different points of view 24 of respective FIGS. 1A, 1B, 1C. The virtual visual scene 22 is determined by the point of view 24 within the virtual visual space 20 and a field of view 26. The virtual visual scene 22 is at least partially displayed to a user.

The virtual visual scenes 22 illustrated may be mediated reality scenes, virtual reality scenes or augmented reality scenes. A virtual reality scene displays a fully artificial virtual visual space 20. An augmented reality scene displays a partially artificial, partially real virtual visual space 20.

The mediated reality, augmented reality or virtual reality may be user interactive-mediated. In this case, user actions at least partially determine what happens within the virtual visual space 20. This may enable interaction with a virtual object 21 such as a visual element 28 within the virtual visual space 20.

The mediated reality, augmented reality or virtual reality may be perspective-mediated. In this case, user actions determine the point of view 24 within the virtual visual space 20, changing the virtual visual scene 22. For example, as illustrated in FIGS. 1A, 1B, 1C a position 23 of the point of view 24 within the virtual visual space 20 may be changed and/or a direction or orientation 25 of the point of view 24 within the virtual visual space 20 may be changed. If the virtual visual space 20 is three-dimensional, the position 23 of the point of view 24 has three degrees of freedom e.g. up/down, forward/back, left/right and the direction 25 of the point of view 24 within the virtual visual space 20 has three degrees of freedom e.g. roll, pitch, yaw. The point of view 24 may be continuously variable in position 23 and/or direction 25 and user action then changes the position and/or direction of the point of view 24 continuously. Alternatively, the point of view 24 may have discrete quantised positions 23 and/or discrete quantised directions 25 and user action switches by discretely jumping between the allowed positions 23 and/or directions 25 of the point of view 24.

Figure 3A:
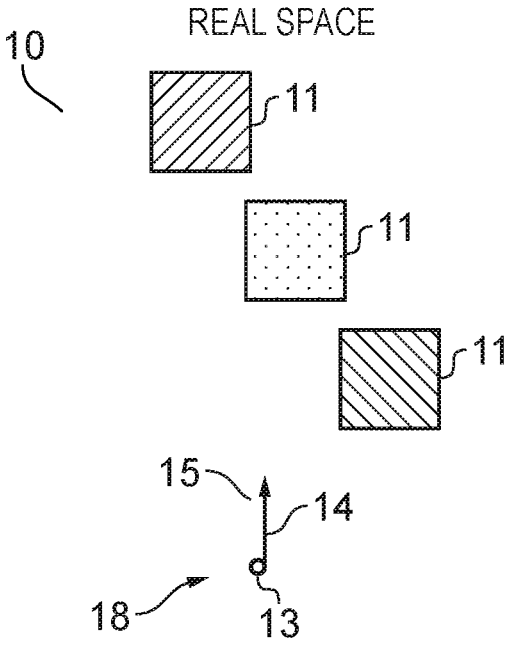
FIG. 3A illustrates an example of a real space and FIG. 3B illustrates an example of a real visual scene that partially corresponds with the virtual visual scene of FIG. 1B.

FIG. 3A illustrates a real space 10 comprising real objects 11 that partially corresponds with the virtual visual space 20 of FIG. 1A. In this example, each real object 11 in the real space 10 has a corresponding virtual object 21 in the virtual visual space 20, however, each virtual object 21 in the virtual visual space 20 does not have a corresponding real object 11 in the real space 10. In this example, one of the virtual objects 21, the computer-generated visual element 28, is an artificial virtual object 21 that does not have a corresponding real object 11 in the real space 10.

A linear mapping may exist between the real space 10 and the virtual visual space 20 and the same mapping exists between each real object 11 in the real space 10 and its corresponding virtual object 21. The relative relationship of the real objects 11 in the real space 10 is therefore the same as the relative relationship between the corresponding virtual objects 21 in the virtual visual space 20.

Figure 3B:
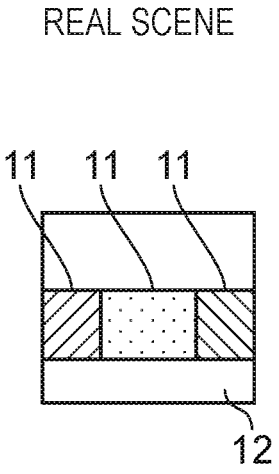

FIG. 3B illustrates a real visual scene 12 that partially corresponds with the virtual visual scene 22 of FIG. 1B, it includes real objects 11 but not artificial virtual objects. The real visual scene is from a perspective corresponding to the point of view 24 in the virtual visual space 20 of FIG. 1A. The real visual scene 12 content is determined by that corresponding point of view 24 and the field of view 26 in virtual space 20 (point of view 14 in real space 10).

FIG. 2A may be an illustration of an augmented reality version of the real visual scene 12 illustrated in FIG. 3B. The virtual visual scene 22 comprises the real visual scene 12 of the real space 10 supplemented by one or more visual elements 28 displayed by an apparatus to a user. The visual elements 28 may be a computer-generated visual element. In a see-through arrangement, the virtual visual scene 22 comprises the actual real visual scene 12 which is seen through a display of the supplemental visual element(s) 28. In a see-video arrangement, the virtual visual scene 22 comprises a displayed real visual scene 12 and displayed supplemental visual element(s) 28. The displayed real visual scene 12 may be based on an image from a single point of view 24 or on multiple images from different points of view 24 at the same time, processed to generate an image from a single point of view 24.

Figure 4:
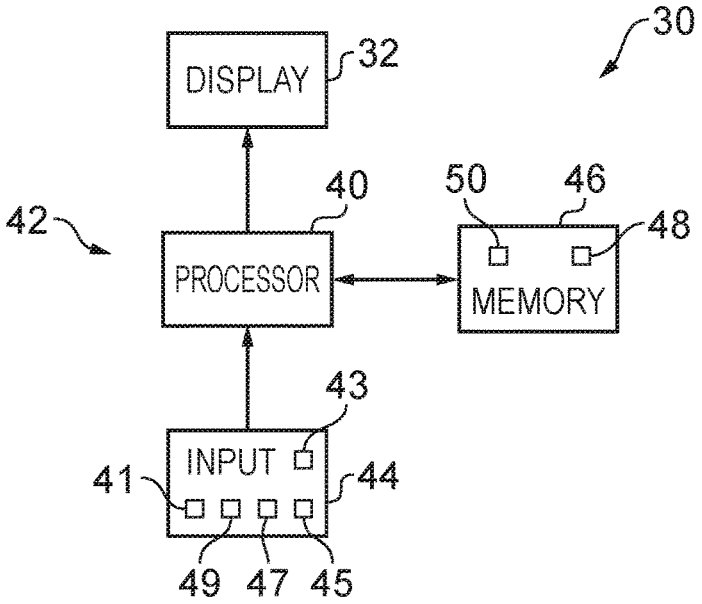
FIG. 4 illustrates an example of an apparatus that is operable to enable mediated reality and/or augmented reality and/or virtual reality.

FIG. 4 illustrates an example of an apparatus 30 that is operable to enable mediated reality and/or augmented reality and/or virtual reality.

The apparatus 30 comprises a display 32 for providing at least parts of the virtual visual scene 22 to a user in a form that is perceived visually by the user. The display 32 may be a visual display that provides light that displays at least parts of the virtual visual scene 22 to a user. Examples of visual displays include liquid crystal displays, organic light emitting displays, emissive, reflective, transmissive and transflective displays, direct retina projection display, near eye displays etc.

The display 32 is controlled in this example but not necessarily all examples by a controller 42.

Implementation of a controller 42 may be as controller circuitry. The controller 42 may be implemented in hardware alone, have certain aspects in software including firmware alone or can be a combination of hardware and software (including firmware).

As illustrated in FIG. 4 the controller 42 may be implemented using instructions that enable hardware functionality, for example, by using executable computer program instructions 48 in a general-purpose or special-purpose processor 40 that may be stored on a computer readable storage medium (disk, memory etc) to be executed by such a processor 40.

The processor 40 is configured to read from and write to the memory 46. The processor 40 may also comprise an output interface via which data and/or commands are output by the processor 40 and an input interface via which data and/or commands are input to the processor 40.

The memory 46 stores a computer program 48 comprising computer program instructions (computer program code) that controls the operation of the apparatus 30 when loaded into the processor 40. The computer program instructions, of the computer program 48, provide the logic and routines that enables the apparatus to perform the methods illustrated in FIGS. 5A & 5B. The processor 40 by reading the memory 46 is able to load and execute the computer program 48.

Figure 5A:
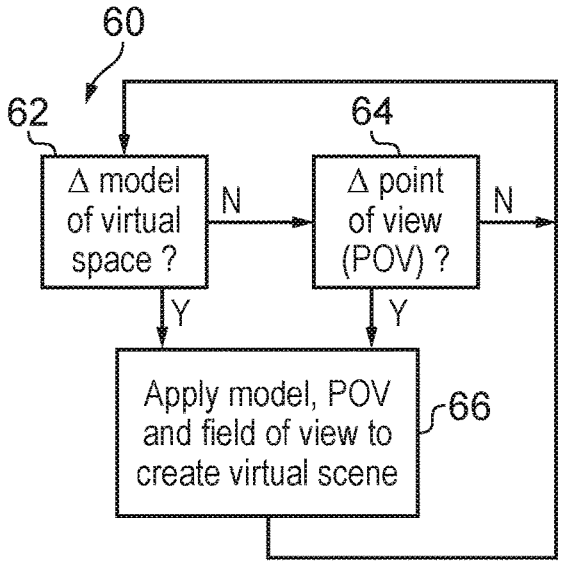
FIG. 5A illustrates an example of a method for enabling mediated reality and/or augmented reality and/or virtual reality.
Figure 5B:
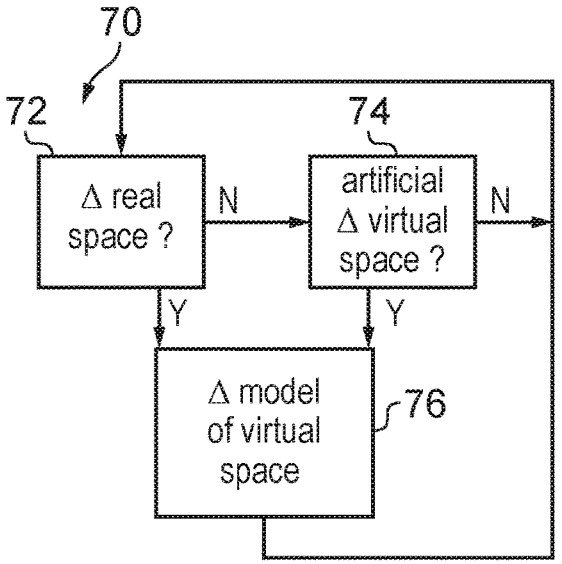
FIG. 5B illustrates an example of a method for updating a model of the virtual visual space for augmented reality.

The blocks illustrated in the FIGS. 5A & 5B may represent steps in a method and/or sections of code in the computer program 48. The illustration of a particular order to the blocks does not necessarily imply that there is a required or preferred order for the blocks and the order and arrangement of the block may be varied. Furthermore, it may be possible for some blocks to be omitted.

The apparatus 30 may enable mediated reality and/or augmented reality and/or virtual reality, for example using the method 60 illustrated in FIG. 5A or a similar method. The controller 42 stores and maintains a model 50 of the virtual visual space 20. The model may be provided to the controller 42 or determined by the controller 42. For example, sensors in input circuitry 44 may be used to create overlapping depth maps of the virtual visual space from different points of view and a three dimensional model may then be produced.

There are many different technologies that may be used to create a depth map. An example of a passive system, used in the Kinect™ device, is when an object is painted with a non-homogenous pattern of symbols using infrared light and the reflected light is measured using multiple cameras and then processed, using the parallax effect, to determine a position of the object.

At block 62 it is determined whether or not the model of the virtual visual space 20 has changed. If the model of the virtual visual space 20 has changed the method moves to block 66. If the model of the virtual visual space 20 has not changed the method moves to block 64.

At block 64 it is determined whether or not the point of view 24 in the virtual visual space 20 has changed. If the point of view 24 has changed the method moves to block 66. If the point of view 24 has not changed the method returns to block 62.

At block 66, a two-dimensional projection of the three-dimensional virtual visual space 20 is taken from the location 23 and in the direction 25 defined by the current point of view 24. The projection is then limited by the field of view 26 to produce the virtual visual scene 22. The method then returns to block 62.

Where the apparatus 30 enables augmented reality, the virtual visual space 20 comprises objects 11 from the real space 10 and also visual elements 28 not present in the real space 10. The combination of such visual elements 28 may be referred to as the artificial virtual visual space. FIG. 5B illustrates a method 70 for updating a model of the virtual visual space 20 for augmented reality.

At block 72 it is determined whether or not the real space 10 has changed. If the real space 10 has changed the method moves to block 76. If the real space 10 has not changed the method moves to block 74. Detecting a change in the real space 10 may be achieved at a pixel level using differencing and may be achieved at an object level using computer vision to track objects as they move.

At block 74 it is determined whether or not the artificial virtual visual space has changed. If the artificial virtual visual space has changed the method moves to block 76. If the artificial virtual visual space has not changed the method returns to block 72. As the artificial virtual visual space is generated by the controller 42 changes to the visual elements 28 are easily detected.

At block 76, the model of the virtual visual space 20 is updated.

The apparatus 30 may enable user-interactive mediation for mediated reality and/or augmented reality and/or virtual reality. The user input circuitry 44 detects user actions using user input 43. These user actions are used by the controller 42 to determine what happens within the virtual visual space 20. This may enable interaction with a visual element 28 within the virtual visual space 20.

The apparatus 30 may enable perspective mediation for mediated reality and/or augmented reality and/or virtual reality. The user input circuitry 44 detects user actions. These user actions are used by the controller 42 to determine the point of view 24 within the virtual visual space 20, changing the virtual visual scene 22. The point of view 24 may be continuously variable in position and/or direction and user action changes the position and/or direction of the point of view 24. Alternatively, the point of view 24 may have discrete quantised positions and/or discrete quantised directions and user action switches by jumping to the next position and/or direction of the point of view 24.

The apparatus 30 may enable first person perspective for mediated reality, augmented reality or virtual reality. The user input circuitry 44 detects the user's real point of view 14 using user point of view sensor 45. The user's real point of view is used by the controller 42 to determine the point of view 24 within the virtual visual space 20, changing the virtual visual scene 22. Referring back to FIG. 3A, a user 18 has a real point of view 14. The real point of view may be changed by the user 18. For example, a real location 13 of the real point of view 14 is the location of the user 18 and can be changed by changing the physical location 13 of the user 18. For example, a real direction 15 of the real point of view 14 is the direction in which the user 18 is looking and can be changed by changing the real direction of the user 18. The real direction 15 may, for example, be changed by a user 18 changing an orientation of their head or view point and/or a user changing a direction of their gaze. A head-mounted apparatus 30 may be used to enable first-person perspective mediation by measuring a change in orientation of the user's head and/or a change in the user's direction of gaze.

In some but not necessarily all examples, the apparatus 30 comprises as part of the input circuitry 44 point of view sensors 45 for determining changes in the real point of view.

For example, positioning technology such as GPS, triangulation (trilateration) by transmitting to multiple receivers and/or receiving from multiple transmitters, acceleration detection and integration may be used to determine a new physical location 13 of the user 18 and real point of view 14.

For example, accelerometers, electronic gyroscopes or electronic compasses may be used to determine a change in an orientation of a user's head or view point and a consequential change in the real direction 15 of the real point of view 14.

For example, pupil tracking technology, based for example on computer vision, may be used to track movement of a user's eye or eyes and therefore determine a direction of a user's gaze and consequential changes in the real direction 15 of the real point of view 14.

The apparatus 30 may comprise as part of the input circuitry 44 image sensors 47 for imaging the real space 10.

An example of an image sensor 47 is a digital image sensor that is configured to operate as a camera. Such a camera may be operated to record static images and/or video images In some, but not necessarily all embodiments, cameras may be configured in a stereoscopic or other spatially distributed arrangement so that the real space 10 is viewed from different perspectives. This may enable the creation of a three-dimensional image and/or processing to establish depth, for example, via the parallax effect.

In some, but not necessarily all embodiments, the input circuitry 44 comprises depth sensors 49. A depth sensor 49 may comprise a transmitter and a receiver. The transmitter transmits a signal (for example, a signal a human cannot sense such as ultrasound or infrared light) and the receiver receives the reflected signal. Using a single transmitter and a single receiver some depth information may be achieved via measuring the time of flight from transmission to reception. Better resolution may be achieved by using more transmitters and/or more receivers (spatial diversity). In one example, the transmitter is configured to 'paint' the real space 10 with light, preferably invisible light such as infrared light, with a spatially dependent pattern. Detection of a certain pattern by the receiver allows the real space 10 to be spatially resolved. The distance to the spatially resolved portion of the real space 10 may be determined by time of flight and/or stereoscopy (if the receiver is in a stereoscopic position relative to the transmitter).

In some but not necessarily all embodiments, the input circuitry 44 may comprise communication circuitry 41 in addition to or as an alternative to one or more of the image sensors 47 and the depth sensors 49. Such communication circuitry 41 may communicate with one or more remote image sensors 47 in the real space 10 and/or with remote depth sensors 49 in the real space 10.

Figure 6A:
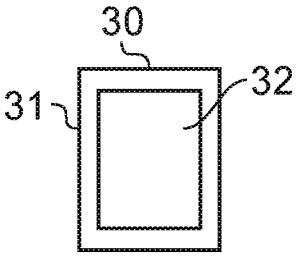
FIGS. 6A and 6B illustrate examples of apparatus that enable display of at least parts of the virtual visual scene to a user.
Figure 6B:
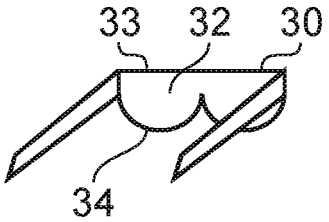

FIGS. 6A and 6B illustrate examples of apparatus 30 that enable display of at least parts of the virtual visual scene 22 to a user.

FIG. 6A illustrates a handheld apparatus 31 comprising a display screen as display 32 that displays images to a user and is used for displaying the virtual visual scene 22 to the user. The apparatus 30 may be moved deliberately in the hands of a user in one or more of the previously mentioned six degrees of freedom. The handheld apparatus 31 may house the sensors 45 for determining changes in the real point of view from a change in orientation of the apparatus 30.

The handheld apparatus 31 may be or may be operated as a see-video arrangement for augmented reality that enables a live or recorded video of a real visual scene 12 to be displayed on the display 32 for viewing by the user while one or more visual elements 28 are simultaneously displayed on the display 32 for viewing by the user. The combination of the displayed real visual scene 12 and displayed one or more visual elements 28 provides the virtual visual scene 22 to the user.

If the handheld apparatus 31 has a camera mounted on a face opposite the display 32, it may be operated as a see-video arrangement that enables a live real visual scene 12 to be viewed while one or more visual elements 28 are displayed to the user to provide in combination the virtual visual scene 22.

FIG. 6B illustrates a head-mounted apparatus 33 comprising a display 32 that displays images to a user. The head-mounted apparatus 33 may be moved automatically when a head of the user moves. The head-mounted apparatus 33 may house the sensors 45 for gaze direction detection and/or selection gesture detection.

The head-mounted apparatus 33 may be a see-through arrangement for augmented reality that enables a live real visual scene 12 to be viewed while one or more visual elements 28 are displayed by the display 32 to the user to provide in combination the virtual visual scene 22. In this case a visor 34, if present, is transparent or semi-transparent so that the live real visual scene 12 can be viewed through the visor 34.

The head-mounted apparatus 33 may be operated as a see-video arrangement for augmented reality that enables a live or recorded video of a real visual scene 12 to be displayed by the display 32 for viewing by the user while one or more visual elements 28 are simultaneously displayed by the display 32 for viewing by the user. The combination of the displayed real visual scene 12 and displayed one or more visual elements 28 provides the virtual visual scene 22 to the user. In this case a visor 34 is opaque and may be used as display 32.

Other examples of apparatus 30 that enable display of at least parts of the virtual visual scene 22 to a user may be used.

For example, one or more projectors may be used that project one or more visual elements to provide augmented reality by supplementing a real visual scene of a physical real world environment (real space).

For example, multiple projectors or displays may surround a user to provide virtual reality by presenting a fully artificial environment (a virtual visual space) as a virtual visual scene to the user.

Referring back to FIG. 4, an apparatus 30 may enable user-interactive mediation for mediated reality and/or augmented reality and/or virtual reality. The user input circuitry 44 detects user actions using user input 43. These user actions are used by the controller 42 to determine what happens within the virtual visual space 20. This may enable interaction with a visual element 28 within the virtual visual space 20.

The detected user actions may, for example, be gestures performed in the real space 10. Gestures may be detected in a number of ways. For example, depth sensors 49 may be used to detect movement of parts a user 18 and/or or image sensors 47 may be used to detect movement of parts of a user 18 and/or positional/movement sensors attached to a limb of a user 18 may be used to detect movement of the limb.

Object tracking may be used to determine when an object or user changes. For example, tracking the object on a large macro-scale allows one to create a frame of reference that moves with the object. That frame of reference can then be used to track time-evolving changes of shape of the object, by using temporal differencing with respect to the object. This can be used to detect small scale human motion such as gestures, hand movement, finger movement, facial movement. These are scene independent user (only) movements relative to the user.

The apparatus 30 may track a plurality of objects and/or points in relation to a user's body, for example one or more joints of the user's body. In some examples, the apparatus 30 may perform full body skeletal tracking of a user's body. In some examples, the apparatus 30 may perform digit tracking of a user's hand.

The tracking of one or more objects and/or points in relation to a user's body may be used by the apparatus 30 in gesture recognition.

Figure 7A:
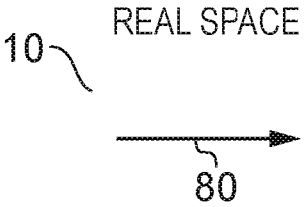
FIG. 7A, illustrates an example of a gesture in real space

Referring to FIG. 7A, a particular gesture 80 in the real space 10 is a gesture user input used as a 'user control' event by the controller 42 to determine what happens within the virtual visual space 20. A gesture user input is a gesture 80 that has meaning to the apparatus 30 as a user input.

Figure 7B:
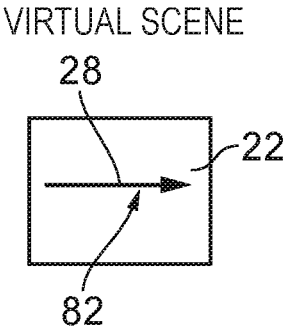
FIG. 7B, illustrates a corresponding representation rendered, in the virtual visual scene, of the gesture in real space.

Referring to FIG. 7B, illustrates that in some but not necessarily all examples, a corresponding representation of the gesture 80 in real space is rendered in the virtual visual scene 22 by the apparatus 30. The representation involves one or more visual elements 28 moving 82 to replicate or indicate the gesture 80 in the virtual visual scene 22.

A gesture 80 may be static or moving. A moving gesture may comprise a movement or a movement pattern comprising a series of movements. For example it could be making a circling motion or a side to side or up and down motion or the tracing of a sign in space. A moving gesture may, for example, be an apparatus-independent gesture or an apparatus-dependent gesture. A moving gesture may involve movement of a user input object e.g. a user body part or parts, or a further apparatus, relative to the sensors. The body part may comprise the user's hand or part of the user's hand such as one or more fingers and thumbs. In other examples, the user input object may comprise a different part of the body of the user such as their head or arm. Three-dimensional movement may comprise motion of the user input object in any of six degrees of freedom. The motion may comprise the user input object moving towards or away from the sensors as well as moving in a plane parallel to the sensors or any combination of such motion.

A gesture 80 may be a non-contact gesture. A non-contact gesture does not contact the sensors at any time during the gesture.

A gesture 80 may be an absolute gesture that is defined in terms of an absolute displacement from the sensors. Such a gesture may be tethered, in that it is performed at a precise location in the real space 10. Alternatively a gesture 80 may be a relative gesture that is defined in terms of relative displacement during the gesture. Such a gesture may be un-tethered, in that it need not be performed at a precise location in the real space 10 and may be performed at a large number of arbitrary locations.

A gesture 80 may be defined as evolution of displacement, of a tracked point relative to an origin, with time. It may, for example, be defined in terms of motion using time variable parameters such as displacement, velocity or using other kinematic parameters. An un-tethered gesture may be defined as evolution of relative displacement $\Delta d$ with relative time $\Delta t$.

A gesture 80 may be performed in one spatial dimension (1D gesture), two spatial dimensions (2D gesture) or three spatial dimensions (3D gesture).

Figure 8:
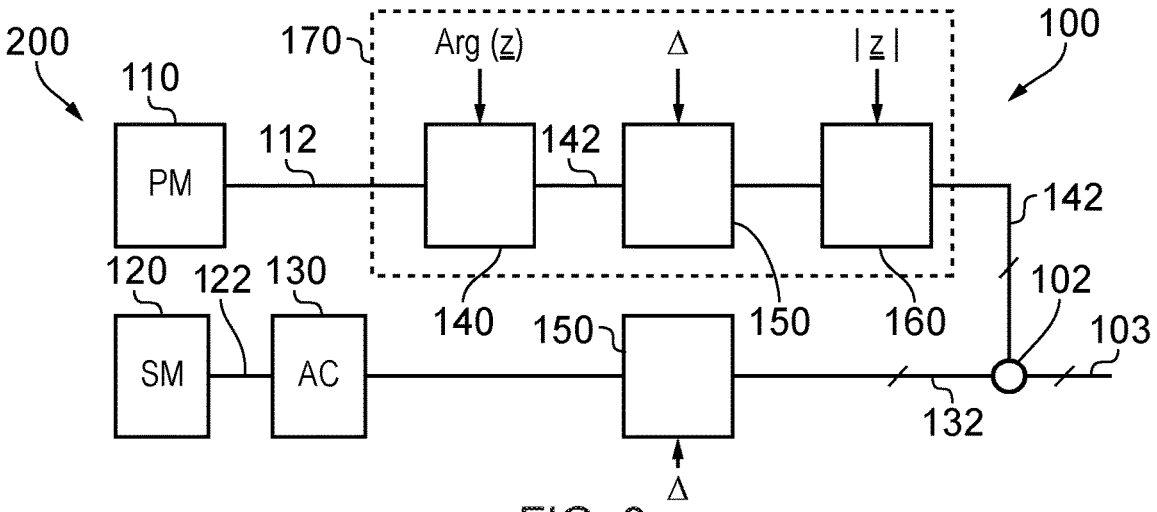
FIG. 8 illustrates an example of a system for modifying a rendered sound scene.

FIG. 8 illustrates an example of a system 100 and also an example of a method 200. The system 100 and method 200 record a sound space and process the recorded sound space to enable a rendering of the recorded sound space as a rendered sound scene for a listener at a particular position (the origin) and orientation within the sound space.

A sound space is an arrangement of sound sources in a three-dimensional space. A sound space may be defined in relation to recording sounds (a recorded sound space) and in relation to rendering sounds (a rendered sound space).

The system 100 comprises one or more portable microphones 110 and may comprise one or more static microphones 120.

In this example, but not necessarily all examples, the origin of the sound space is at a microphone. In this example, the microphone at the origin is a static microphone 120. It may record one or more channels, for example it may be a microphone array. However, the origin may be at any arbitrary position.

In this example, only a single static microphone 120 is illustrated. However, in other examples multiple static microphones 120 may be used independently.

The system 100 comprises one or more portable microphones 110. The portable microphone 110 may, for example, move with a sound source within the recorded sound space. The portable microphone may, for example, be an 'up-close' microphone that remains close to a sound source. This may be achieved, for example, using a boom microphone or, for example, by attaching the microphone to the sound source, for example, by using a Lavalier microphone. The portable microphone 110 may record one or more recording channels.

The relative position of the portable microphone PM 110 from the origin may be represented by the vector z. The vector z therefore positions the portable microphone 110 relative to a notional listener of the recorded sound space.

The relative orientation of the notional listener at the origin may be represented by the value $\Delta$. The orientation value $\Delta$ defines the notional listener's 'point of view' which defines the sound scene. The sound scene is a representation of the sound space listened to from a particular point of view within the sound space.

When the sound space as recorded is rendered to a user (listener) via the system 100 in FIG. 1, it is rendered to the listener as if the listener is positioned at the origin of the recorded sound space with a particular orientation. It is therefore important that, as the portable microphone 110 moves in the recorded sound space, its position z relative to the origin of the recorded sound space is tracked and is correctly represented in the rendered sound space. The system 100 is configured to achieve this.

The audio signals 122 output from the static microphone 120 are coded by audio coder 130 into a multichannel audio signal 132. If multiple static microphones were present, the output of each would be separately coded by an audio coder into a multichannel audio signal.

The audio coder 130 may be a spatial audio coder such that the multichannel audio signals 132 represent the sound space as recorded by the static microphone 120 and can be rendered giving a spatial audio effect. For example, the audio coder 130 may be configured to produce multichannel audio signals 132 according to a defined standard such as, for example, binaural coding, 5.1 surround sound coding, 7.1 surround sound coding etc. If multiple static microphones were present, the multichannel signal of each static microphone would be produced according to the same defined standard such as, for example, binaural coding, 5.1 surround sound coding, and 7.1 surround sound coding and in relation to the same common rendered sound space.

The multichannel audio signals 132 from one or more the static microphones 120 are mixed by mixer 102 with multichannel audio signals 142 from the one or more portable microphones 110 to produce a multi-microphone multichannel audio signal 103 that represents the recorded sound scene relative to the origin and which can be rendered by an audio decoder corresponding to the audio coder 130 to reproduce a rendered sound scene to a listener that corresponds to the recorded sound scene when the listener is at the origin.

The multichannel audio signal 142 from the, or each, portable microphone 110 is processed before mixing to take account of any movement of the portable microphone 110 relative to the origin at the static microphone 120.

The audio signals 112 output from the portable microphone 110 are processed by the positioning block 140 to adjust for movement of the portable microphone 110 relative to the origin. The positioning block 140 takes as an input the vector z or some parameter or parameters dependent upon the vector z. The vector z represents the relative position of the portable microphone 110 relative to the origin.

The positioning block 140 may be configured to adjust for any time misalignment between the audio signals 112 recorded by the portable microphone 110 and the audio signals 122 recorded by the static microphone 120 so that they share a common time reference frame. This may be achieved, for example, by correlating naturally occurring or artificially introduced (non-audible) audio signals that are present within the audio signals 112 from the portable microphone 110 with those within the audio signals 122 from the static microphone 120. Any timing offset identified by the correlation may be used to delay/advance the audio signals 112 from the portable microphone 110 before processing by the positioning block 140.

The positioning block 140 processes the audio signals 112 from the portable microphone 110, taking into account the relative orientation (Arg(z)) of that portable microphone 110 relative to the origin at the static microphone 120.

The audio coding of the static microphone audio signals 122 to produce the multichannel audio signal 132 assumes a particular orientation of the rendered sound space relative to an orientation of the recorded sound space and the audio signals 122 are encoded to the multichannel audio signals 132 accordingly.

The relative orientation Arg (z) of the portable microphone 110 in the recorded sound space is determined and the audio signals 112 representing the sound object are coded to the multichannels defined by the audio coding 130 such that the sound object is correctly oriented within the rendered sound space at a relative orientation Arg (z) from the listener. For example, the audio signals 112 may first be mixed or encoded into the multichannel signals 142 and then a transformation T may be used to rotate the multichannel audio signals 142, representing the moving sound object, within the space defined by those multiple channels by Arg (z).

An orientation block 150 may be used to rotate the multichannel audio signals 142 by Δ, if necessary. Similarly, an orientation block 150 may be used to rotate the multichannel audio signals 132 by Δ, if necessary.

The functionality of the orientation block 150 is very similar to the functionality of the orientation function of the positioning block 140 except it rotates by A instead of Arg(z).

In some situations, for example when the sound scene is rendered to a listener through a head-mounted audio output device 300, for example headphones using binaural audio coding, it may be desirable for the rendered sound space 310 to remain fixed in space 320 when the listener turns their head 330 in space. This means that the rendered sound space 310 needs to be rotated relative to the audio output device 300 by the same amount in the opposite sense to the head rotation. The orientation of the rendered sound space 310 tracks with the rotation of the listener's head so that the orientation of the rendered sound space 310 remains fixed in space 320 and does not move with the listener's head 330.

The portable microphone signals 112 are additionally processed to control the perception of the distance D of the sound object from the listener in the rendered sound scene, for example, to match the distance |z| of the sound object from the origin in the recorded sound space. This can be useful when binaural coding is used so that the sound object is, for example, externalized from the user and appears to be at a distance rather than within the user's head, between the user's ears. The distance block 160 processes the multichannel audio signal 142 to modify the perception of distance.

Figure 9:
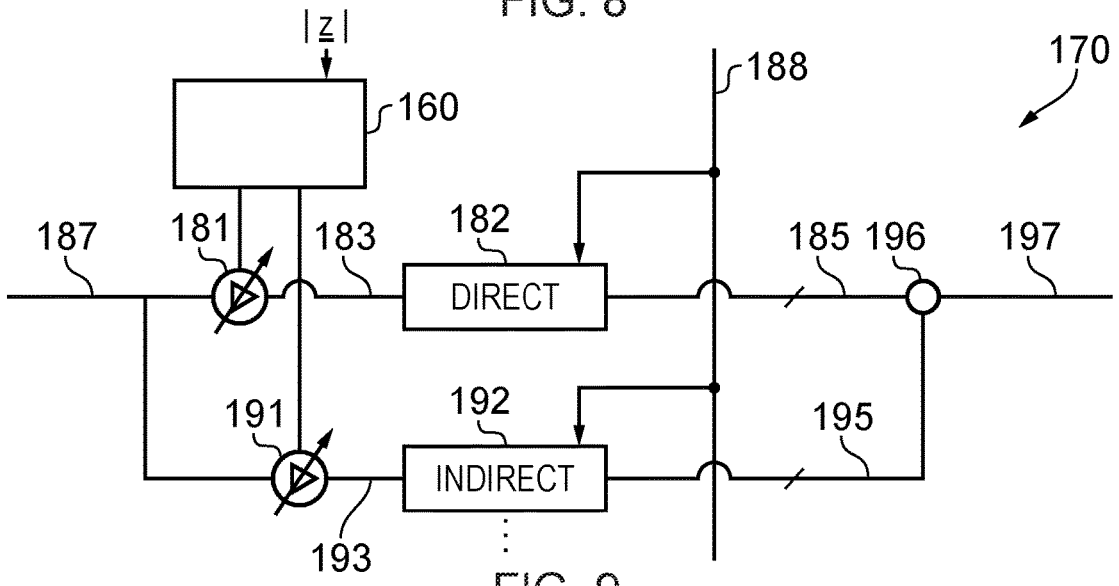
FIG. 9 illustrates an example of a module which may be used, for example, to perform the functions of the positioning block, orientation block and distance block of the system.

FIG. 9 illustrates a module 170 which may be used, for example, to perform the method 200 and/or functions of the positioning block 140, orientation block 150 and distance block 160 in FIG. 8. The module 170 may be implemented using circuitry and/or programmed processors.

The Figure illustrates the processing of a single channel of the multichannel audio signal 142 before it is mixed with the multichannel audio signal 132 to form the multi-microphone multichannel audio signal 103. A single input channel of the multichannel signal 142 is input as signal 187.

The input signal 187 passes in parallel through a "direct" path and one or more "indirect" paths before the outputs from the paths are mixed together, as multichannel signals, by mixer 196 to produce the output multichannel signal 197. The output multichannel signal 197, for each of the input channels, are mixed to form the multichannel audio signal 142 that is mixed with the multichannel audio signal 132.

The direct path represents audio signals that appear, to a listener, to have been received directly from an audio source and an indirect path represents audio signals that appear to a listener to have been received from an audio source via an indirect path such as a multipath or a reflected path or a refracted path.

The distance block 160 by modifying the relative gain between the direct path and the indirect paths, changes the perception of the distance D of the sound object from the listener in the rendered sound space 310.

Each of the parallel paths comprises a variable gain device 181, 191 which is controlled by the distance block 160.

The perception of distance can be controlled by controlling relative gain between the direct path and the indirect (decorrelated) paths. Increasing the indirect path gain relative to the direct path gain increases the perception of distance.

In the direct path, the input signal 187 is amplified by variable gain device 181, under the control of the distance block 160, to produce a gain-adjusted signal 183. The gain-adjusted signal 183 is processed by a direct processing module 182 to produce a direct multichannel audio signal 185.

In the indirect path, the input signal 187 is amplified by variable gain device 191, under the control of the distance block 160, to produce a gain-adjusted signal 193. The gain-adjusted signal 193 is processed by an indirect processing module 192 to produce an indirect multichannel audio signal 195.

The direct multichannel audio signal 185 and the one or more indirect multichannel audio signals 195 are mixed in the mixer 196 to produce the output multichannel audio signal 197.

The direct processing block 182 and the indirect processing block 192 both receive direction of arrival signals 188. The direction of arrival signal 188 gives the orientation Arg(z) of the portable microphone 110 (moving sound object) in the recorded sound space and the orientation Δ of the rendered sound space 310 relative to the notional listener/audio output device 300.

The position of the moving sound object changes as the portable microphone 110 moves in the recorded sound space and the orientation of the rendered sound space changes as a head-mounted audio output device rendering the sound space rotates.

The direct processing block 182 may, for example, include a system 184 that rotates the single channel audio signal, gain-adjusted input signal 183, in the appropriate multichannel space producing the direct multichannel audio signal 185. The system uses a transfer function to performs a transformation T that rotates multichannel signals within the space defined for those multiple channels by Arg(z) and by Δ, defined by the direction of arrival signal 188. For example, a head related transfer function (HRTF) interpolator may be used for binaural audio. As another example, Vector Base Amplitude Panning (VBAP) may be used for loudspeaker format (e.g. 5.1) audio.

The indirect processing block 192 may, for example, use the direction of arrival signal 188 to control the gain of the single channel audio signal, the gain-adjusted input signal 193, using a variable gain device 194. The amplified signal is then processed using a static decorrelator 196 and a static transformation T to produce the indirect multichannel audio signal 195. The static decorrelator in this example uses a pre-delay of at least 2 ms. The transformation T rotates multichannel signals within the space defined for those multiple channels in a manner similar to the direct system but by a fixed amount. For example, a static head related transfer function (HRTF) interpolator may be used for binaural audio.

It will therefore be appreciated that the module 170 can be used to process the portable microphone signals 112 and perform the functions of:

(i) changing the relative position (orientation Arg(z) and/or distance |z|) of a rendered sound object, from a listener in the rendered sound space and (ii) changing the orientation of the rendered sound space (including the rendered sound object positioned according to (i)).

It should also be appreciated that the module 170 may also be used for performing the function of the orientation block 150 only, when processing the audio signals 122 provided by the static microphone 120. However, the direction of arrival signal will include only Δ and will not include Arg(z). In some but not necessarily all examples, gain of the variable gain devices 191 modifying the gain to the indirect paths may be put to zero and the gain of the variable gain device 181 for the direct path may be fixed. In this instance, the module 170 reduces to a system that rotates the recorded sound space to produce the rendered sound space according to a direction of arrival signal that includes only Δ and does not include Arg(z).

Figure 10:
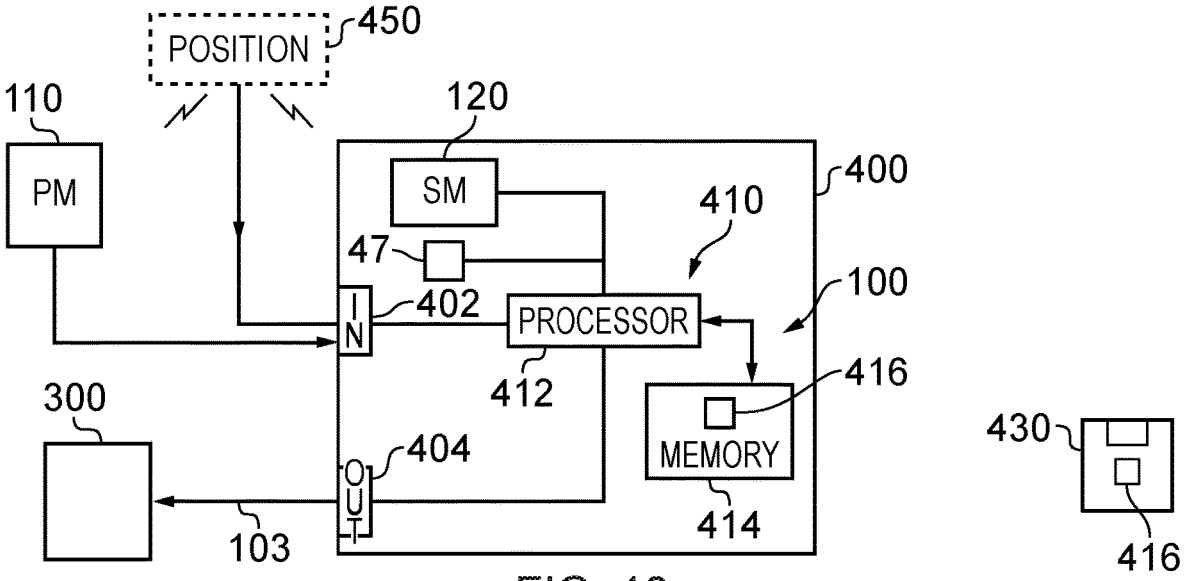
FIG. 10 illustrates an example of the system/module implemented using an apparatus.

FIG. 10 illustrates an example of the system 100 implemented using an apparatus 400. The apparatus 400 may, for example, be a static electronic device, a portable electronic device or a hand-portable electronic device that has a size that makes it suitable to be carried on a palm of a user or in an inside jacket pocket of the user.

In this example, the apparatus 400 comprises the static microphone 120 as an integrated microphone but does not comprise the one or more portable microphones 110 which are remote. In this example, but not necessarily all examples, the static microphone 120 is a microphone array. However, in other examples, the apparatus 400 does not comprise the static microphone 120.

The apparatus 400 comprises an external communication interface 402 for communicating externally with external microphones, for example, the remote portable microphone(s) 110. This may, for example, comprise a radio transceiver.

A positioning system 450 is illustrated as part of the system 100. This positioning system 450 is used to position the portable microphone(s) 110 relative to the origin of the sound space e.g. the static microphone 120. In this example, the positioning system 450 is illustrated as external to both the portable microphone 110 and the apparatus 400. It provides information dependent on the position z of the portable microphone 110 relative to the origin of the sound space to the apparatus 400. In this example, the information is provided via the external communication interface 402, however, in other examples a different interface may be used. Also, in other examples, the positioning system may be wholly or partially located within the portable microphone 110 and/or within the apparatus 400.

The position system 450 provides an update of the position of the portable microphone 110 with a particular frequency and the term 'accurate' and 'inaccurate' positioning of the sound object should be understood to mean accurate or inaccurate within the constraints imposed by the frequency of the positional update. That is accurate and inaccurate are relative terms rather than absolute terms.

The position system 450 enables a position of the portable microphone 110 to be determined. The position system 450 may receive positioning signals and determine a position which is provided to the processor 412 or it may provide positioning signals or data dependent upon positioning signals so that the processor 412 may determine the position of the portable microphone 110.

There are many different technologies that may be used by a position system 450 to position an object including passive systems where the positioned object is passive and does not produce a positioning signal and active systems where the positioned object produces one or more positioning signals. An example of a system, used in the Kinect™ device, is when an object is painted with a non-homogenous pattern of symbols using infrared light and the reflected light is measured using multiple cameras and then processed, using the parallax effect, to determine a position of the object. An example of an active radio positioning system is when an object has a transmitter that transmits a radio positioning signal to multiple receivers to enable the object to be positioned by, for example, trilateration or triangulation. The transmitter may be a Bluetooth tag or a radio-frequency identification (RFID) tag, as an example. An example of a passive radio positioning system is when an object has a receiver or receivers that receive a radio positioning signal from multiple transmitters to enable the object to be positioned by, for example, trilateration or triangulation. Trilateration requires an estimation of a distance of the object from multiple, non-aligned, transmitter/receiver locations at known positions. A distance may, for example, be estimated using time of flight or signal attenuation. Triangulation requires an estimation of a bearing of the object from multiple, non-aligned, transmitter/receiver locations at known positions. A bearing may, for example, be estimated using a transmitter that transmits with a variable narrow aperture, a receiver that receives with a variable narrow aperture, or by detecting phase differences at a diversity receiver.

Other positioning systems may use dead reckoning and inertial movement or magnetic positioning.

The object that is positioned may be the portable microphone 110 or it may an object worn or carried by a person associated with the portable microphone 110 or it may be the person associated with the portable microphone 110.

The apparatus 400 wholly or partially operates the system 100 and method 200 described above to produce a multi-microphone multichannel audio signal 103.

The apparatus 400 provides the multi-microphone multichannel audio signal 103 via an output communications interface 404 to an audio output device 300 for rendering.

In some but not necessarily all examples, the audio output device 300 may use binaural coding. Alternatively or additionally, in some but not necessarily all examples, the audio output device 300 may be a head-mounted audio output device.

In this example, the apparatus 400 comprises a controller 410 configured to process the signals provided by the static microphone 120 and the portable microphone 110 and the positioning system 450. In some examples, the controller 410 may be required to perform analogue to digital conversion of signals received from microphones 110, 120 and/or perform digital to analogue conversion of signals to the audio output device 300 depending upon the functionality at the microphones 110, 120 and audio output device 300. However, for clarity of presentation no converters are illustrated in FIG. 9.

Implementation of a controller 410 may be as controller circuitry. The controller 410 may be implemented in hardware alone, have certain aspects in software including firmware alone or can be a combination of hardware and software (including firmware).

As illustrated in FIG. 10 the controller 410 may be implemented using instructions that enable hardware functionality, for example, by using executable instructions of a computer program 416 in a general-purpose or special-purpose processor 412 that may be stored on a computer readable storage medium (disk, memory etc) to be executed by such a processor 412.

The processor 412 is configured to read from and write to the memory 414. The processor 412 may also comprise an output interface via which data and/or commands are output by the processor 412 and an input interface via which data and/or commands are input to the processor 412.

The memory 414 stores a computer program 416 comprising computer program instructions (computer program code) that controls the operation of the apparatus 400 when loaded into the processor 412. The computer program instructions, of the computer program 416, provide the logic and routines that enables the apparatus to perform the methods illustrated in FIGS. 1-19. The processor 412 by reading the memory 414 is able to load and execute the computer program 416.

The blocks illustrated in the FIGS. 8 and 9 may represent steps in a method and/or sections of code in the computer program 416. The illustration of a particular order to the blocks does not necessarily imply that there is a required or preferred order for the blocks and the order and arrangement of the block may be varied. Furthermore, it may be possible for some blocks to be omitted.

The preceding description describes, in relation to FIGS. 1 to 7, a system, apparatus 30, method 60 and computer program 48 that enables control of a virtual visual space 20 and the virtual visual scene 26 dependent upon the virtual visual space 20.

The preceding description describes. In relation to FIGS. 8 to 10, a system 100, apparatus 400, method 200 and computer program 416 that enables control of a sound space and the sound scene dependent upon the sound space.

In some but not necessarily all examples, the virtual visual space 20 and the sound space may be corresponding. "Correspondence" or "corresponding" when used in relation to a sound space and a virtual visual space means that the sound space and virtual visual space are time and space aligned, that is they are the same space at the same time.

The correspondence between virtual visual space and sound space results in correspondence between the virtual visual scene and the sound scene. "Correspondence" or "corresponding" when used in relation to a sound scene and a virtual visual scene means that the sound space and virtual visual space are corresponding and a notional listener whose point of view defines the sound scene and a notional viewer whose point of view defines the virtual visual scene are at the same position and orientation, that is they have the same point of view.

The following description describes in relation to FIGS. 11 to 19 a method 520 that enables audio processing, for example spatial audio processing, to be visualized within a virtual visual space 20 using, in particular an arrangement (e.g. routing) and/or appearance of interconnecting virtual visual objects 620 between other virtual objects 21.

Figure 11A:
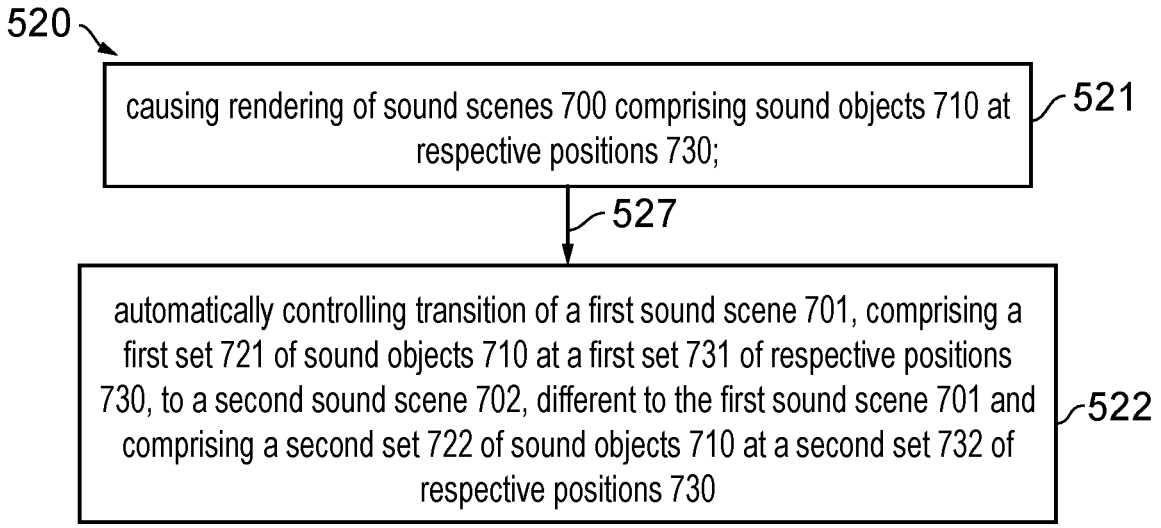
FIG. 11A illustrates an example of a method that enables automatic control of transition between sound scenes.
Figure 11B:
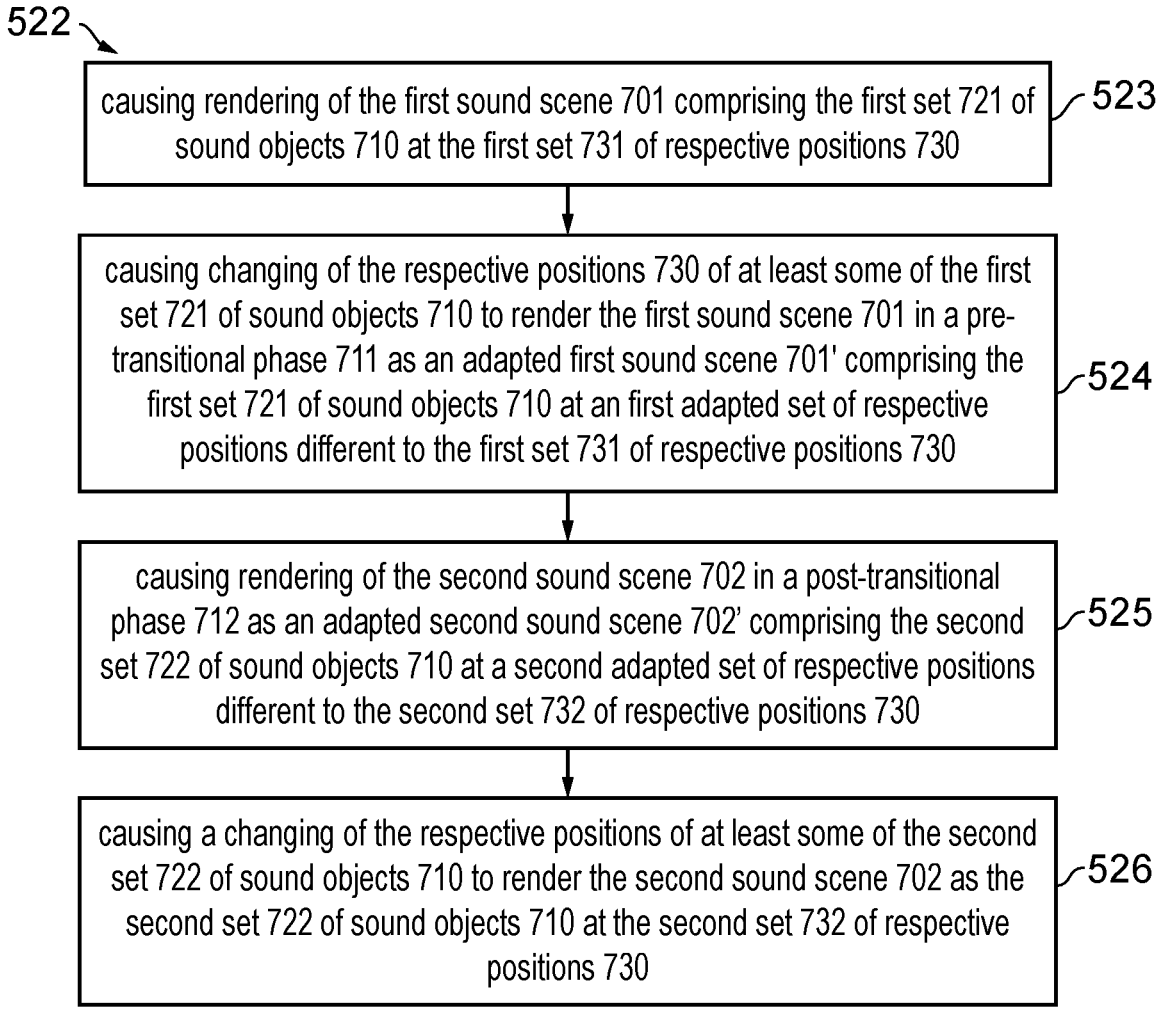
FIG. 11B illustrates an example of a method of automatic control of transition between sound scenes by using a pre-transitional phase and a post-transitional phase in which the sound objects are in adapted positions.

FIGS. 11A and 11B illustrates an example of the method 520 which will be described in more detail with reference to FIGS. 11 to 17.

The method 520 comprises at block 521 causing rendering of sound scenes 700 comprising sound objects 710 at respective positions 730.

The method 520 additionally comprises at block 522 automatically controlling transition 527 of a first sound scene 701, comprising a first set 721 of sound objects 710 at a first set 731 of respective positions 730, to a second sound scene 702, different to the first sound scene 701 and comprising a second set 722 of sound objects 710 at a second set 732 of respective positions 730.

In some but not necessarily all examples, the transition 527 of the first sound scene 701 to the second sound scene 702 is in response to direct or indirect user specification of a change in sound scene from the first sound scene 701 to the second sound scene 702. Direct specification may, for example, occur when the user makes a sound editing command that changes the first sound scene 701 to the second sound scene 702. Indirect specification may, for example, occur when the user makes another command, such as a video editing command, that is interpreted as a user requirement to change the first sound scene 701 to the second sound scene 702. Other examples include switching to another location in a virtual reality video (jump ahead or back in time) or switching the scene in virtual reality video, or changing the music track of audio content with spatial audio content (in this case it is not necessarily to have visual content at all, just spatial audio).

The operation of block 522 is illustrated in more detail in FIG. 11B.

The method 520 comprises at block 523 in FIG. 11B automatically causing rendering of the first sound scene 701 comprising the first set 721 of sound objects 710 at the first set 731 of respective positions 730. An example of a first sound scene 701 is illustrated in FIG. 13A.

The method 520 then comprises at block 524 automatically causing changing of the respective positions 730 of at least some of the first set 721 of sound objects 710 to render the first sound scene 701 in a pre-transitional phase 711 as an adapted first sound scene 701' comprising the first set 721 of sound objects 710 at a first adapted set 731' of respective positions 730 different to the first set 731 of respective positions 730. An example of an adapted first sound scene 701' is illustrated in FIG. 13B.

The method 520 then comprises at block 525 automatically causing rendering of the second sound scene 702 in a post-transitional phase 712 as an adapted second sound scene 702' comprising the second set 722 of sound objects 710 at a second adapted set 732' of respective positions different to the second set 732 of respective positions 730. An example of an adapted second sound scene 702' is illustrated in FIG. 13C.

The method 520 then comprises at block 526 automatically causing a changing of the respective positions 730 of at least some of the second set 722 of sound objects 710 to render the second sound scene 702 as the second set 722 of sound objects 710 at the second set 732 of respective positions 730. An example of an (un-adapted) second sound scene 702 is illustrated in FIG. 13D.

Figure 12A:
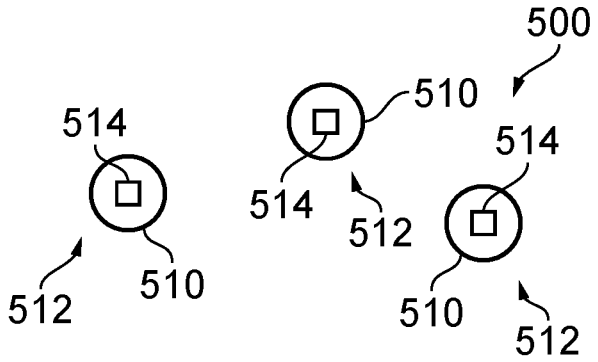
FIG. 12A illustrates an example of a sound space comprising sound objects.

FIG. 12A illustrates an example of a sound space 500 comprising sound objects 510. In this example, the sound space 500 is a recorded sound space and the sound objects 510 are recorded sound objects but in other examples the sound space 500 may be a synthetic sound space and the sound objects 510 may then be sound objects artificially generated ab initio or by mixing other sound objects which may or may not comprise wholly or partly recorded sound objects.

Each sound object 510 has a position 512 in the sound space 500 and has characteristics 514 that define that sound object. The characteristics 514 may for example be audio characteristics for example based on the audio signals 112/122 output from a portable/static microphone 110/120 before or after audio coding. One example of an audio characteristic 514 is volume.

Figure 12B:
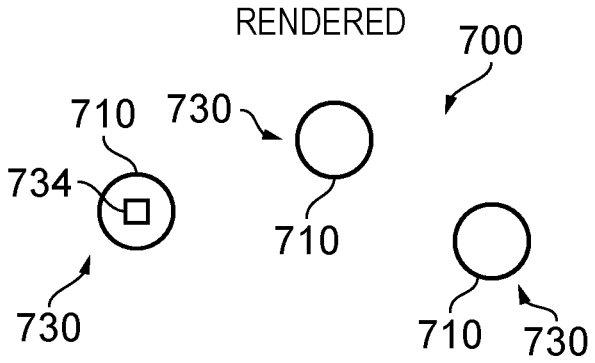
FIG. 12B illustrates an example of a rendered sound scene comprising a plurality of rendered sound objects.

As illustrated in FIG. 12B, when a sound object 510 having position 512 and characteristics 514 is rendered in a rendered sound scene 700 it is rendered as a rendered sound object 710 having a position 730 and characteristics 734. The characteristics 514, 732 may be the same or different characteristics, where they are the same they may have the same or different values. In order to correctly render the sound object 510 as a rendered sound object 710, the position 730 is the same or similar to the position 512 and the characteristics 734 are the same characteristics with the same or similar values compared to the characteristics 514. However, as previously described it is possible to process the audio signals representing a rendered sound object 710 to change a position 730 at which it is rendered and/or change characteristics 734 with which it is rendered.

The method 520 comprises at block 521 and 522 causing audio processing of the sound objects 510 to produce rendered sound objects 710. The processing of different sound objects associated with different sound spaces causes a transition from the first sound scene 701 (comprising the first set 721 of sound objects 710 at the first set 731 of respective positions 730) to the second sound scene 702 (comprising the second different set 722 of sound objects 710 at a second set 732 of respective positions 730).

The different processing of the same sound objects associated with the same first sound space causes a change from the first sound scene 701 immediately before the pre-transitional phase 711 to the adapted first sound scene 701' during the pre-transitional phase 711. The first sound scene comprises the first set 721 of sound objects 710 at the first set 731 of respective positions 730 whereas the adapted first sound scene 701' comprises the first set 721 of sound objects 710 at a first adapted set 731' of respective positions 730 different to the first set 731 of respective positions 730.

The different processing of the same sound objects associated with the same second sound space causes a change from the adapted second sound scene 702 during the post-transitional phase 712 to the second sound scene 702 immediately after the transitional phase 711. The second sound scene 702 comprises the second set 722 of sound objects 710 at a second set 732 of respective positions 730 whereas the adapted second sound scene 702' comprises the second set 722 of sound objects 710 at the second adapted set 732' of respective positions different to the second set 732 of respective positions 730.

In some but not necessarily all examples, the rendering of the first sound scene 701 comprising the first set 721 of sound objects 710 at the first set 731 of respective positions 730 corresponds to rendering first sound objects 510 at their positions 512 within a first sound space 500. The first sound space 500 is therefore correctly rendered. Consequently, the rendering of the adapted first sound scene 701' in the pre-transitional phase 711 does not correspond to rendering the first sound objects 510 at their positions 512 within a first sound space 500. The first sound space 500 is therefore incorrectly rendered.

In some but not necessarily all examples, the rendering of the second sound scene 701 comprising the second set 722 of sound objects 710 at the second set 732 of respective positions 730 corresponds to rendering second sound objects 510 at their positions 512 within a second sound space 500. The second sound space 500 is therefore correctly rendered. Consequently, the rendering of the adapted second sound scene 702' in the post-transitional phase 712 does not correspond to rendering second sound objects 510 at their positions 512 within the second sound space 500. The second sound space 500 is therefore incorrectly rendered.

FIG. 13A illustrates an example of a first sound scene 701 comprising a first set 721 of sound objects 710 at a first set 731 of respective positions 730. Each of the rendered sound objects 710 of the first set 721 of sound objects 710 has a position 730 and one or more characteristics 734. The position 730 positions the sound object 710 within the first sound scene 701 and the characteristics 734 of the sound object 710 control audio characteristics of the sound object 710 when rendered. An example of a characteristic 734 is volume.

FIG. 13D illustrates a second sound scene 702 that is different to the first sound scene 701. The second sound scene 702 comprises a second set 722 of sound objects 710 at a second set 732 of respective positions 730. Each sound object 710 of the second set 722 of sound objects has a position 730 and one or more characteristics 734. The position 734 of a sound object 710 determines where that sound object is rendered within the second sound scene 702 and the characteristics 734 of the sound object 710 control audio characteristics of the sound object 710 when rendered. An example of a characteristic 734 is volume.

In order to assist with understanding of the invention, the sound object 710 of the first set 721 of sound objects are illustrated as circles within the first sound scene 701 and the sound objects 710 of the second set 722 of sound objects are represented as triangles in the illustrated second sound scene 702. The illustrated position of a sound object 710 within an illustrated sound scene is determined by that sound object's position 730. The characteristics 734 of a sound object 710 are graphically illustrated using a size of the icon representing the sound object 710.

It will be appreciated that the sound objects 710, their positions 730 and their characteristics 734 in the first sound scene 701 may be entirely independent of the sound objects 710, their positions 730 and their characteristics 734 in the second sound scene 702.

The method 520 enables a transition from the first sound scene 701 to the second sound scene 702 which comprises different sound objects 710. However, the transition from the first sound scene 701 to the second sound scene 702 is not direct. Instead it leaves the first sound scene 701 (FIG. 13A), passes through a pre-transitional phase 711 of the first sound scene 701 (FIG. 13B) and through a post-transitional phase 712 of the second sound scene 702 (FIG. 13C) before reaching the second sound scene 702 (FIG. 13D).

FIG. 13B illustrates an example of an adapted first sound scene 701' during the pre-transitional phase 711 before the transition 527. The adapted first sound scene 701' comprises the first set 721 of sound objects 710 at a first adapted set 731' of respective positions 730 different to the first set 731 of respective positions 730.

The sound objects 710 that are rendered in the adapted first sound scene 701' are also rendered in the first sound scene 701. In some, but not necessarily all, examples, all of the sound objects 710 rendered in the first sound scene 701 are also rendered in the adapted sound scene 701'.

However, when a sound object 710 is rendered in the adapted first sound scene 701' it may be rendered with a different position 730 and/or one or more different characteristics 734 compared to the first sound scene 701. In the example illustrated, the positions of the sound objects 710 have been changed so that they are all located centrally within the adapted first sound scene 701'.

In this example, but not necessarily all examples, the characteristics of a central sound object 710 or the most central sound objects 710 have not been changed whereas the characteristics of the sound objects 710 that are not central have been changed to de-emphasize them with respect to the central sound object(s) 710.

It will be appreciated that the change from the first sound scene 701 to the adapted first sound scene 701' comprises at least changing of the respective positions 730 of at least some of the first set 721 of sound objects 710.

For the sake of clarity of the figure, the position 730 and characteristic 734 of the sound objects 710 are not explicitly labeled in all instances in the FIGS. 13B, 13C and 13D.

Next a transition 527 of the first sound scene 701 comprising the first set 721 of sound object 710 to a second sound scene 702, different to the first sound scene 701 comprising the second set 722 of sound object 710 occurs.

FIG. 13C illustrates an example of an adapted second sound scene 702' during the post-transitional phase 712 after the transition 527. The adapted second sound scene 702' comprises the second set 722 of sound object 710 at a second adapted set 732' of respective positions different to the second set 732 of respective positions 730.

After the post-transitional phase 712, the adapted second sound scene 702' becomes the second sound scene 702 as illustrated in FIG. 11B. This is achieved by at least changing the respective positions 730 of at least some of the second set 732 of sound object 710 to render the second sound scene 702 as the second set 722 of sound object 710 at the second set 732 of respective positions 730.

The sound objects 710 that are rendered in the adapted second sound scene 702' are also rendered in the second sound scene 702. In some, but not necessarily all, examples, all of the sound objects 710 rendered in the adapted second sound scene 702' are also rendered in the second sound scene 702.

However, when a sound object 710 is rendered in the adapted second sound scene 702' it may be rendered with a different position 730 and/or one or more different characteristics 734 compared to the second sound scene 702. In the example illustrated, the positions of the sound objects 710 are changed so that they are all located centrally within the adapted second sound scene 702'.

In this example, but not necessarily all examples, the characteristics of a central sound object 710 or the most central sound objects 710 are not changed in the adapted second sound scene 702' compared to the second sound scene 702 whereas the characteristics of the sound objects 710 that are not central have been changed to de-emphasize them with respect to the central sound object(s) 710.

It will be appreciated that the change from the adapted second sound scene 702' to the second sound scene 702 comprises at least changing of the respective positions 730 of at least some of the second set 722 of sound objects 710.

It will be appreciated from the foregoing that instead of having a direct transition from the first sound scene 701 to the second sound scene 702 there is an indirect transition from the first sound scene 701 to the second sound scene 702 via the adapted first sound scene 701' during a pre-transitional phase 711 to the adapted second sound scene 702' in a post-transitional phase 712 and then from the adapted second sound scene 702' to the second sound scene 702. While this indirect transition may involve more processing power, it may significantly improve the user experience because the user is not subjected to a sudden and dramatic transition from the first sound scene 701 to the second sound scene 702 but is instead brought through a gradual transition using the pre-transitional phase 711 and post-transitional phase 712.

The pre-transitional phase 711 of the first sound scene 701 may be used to arrange the sound objects 710 of the first sound scene 701 in positions 710 and/or with characteristics 734 that reduce the abruptness of the transition 527 between the first sound scene 701 and the second sound scene 702.

It will be appreciated that different ones of the sound objects 710 in the first set 721 of sound objects will experience different adaptations when a comparison is made between the first sound scene 701 and the first adapted sound scene 701'. For example, as previously described, some sound objects may be moved a significant distance whereas other sound objects may be moved a smaller distance or not moved at all. For example, the characteristics 734 of some sound objects 710 may be changed whereas the characteristics 734 of other sound objects 710 may not be changed. For example, a particular sound object 710 may not have its position 730 changed and may not have its characteristics 734 changed whereas at least some of the other sound objects 710 may have their positions 730 changed so that they are closer to that particular sound object 710 during the pre-transitional phase 711 and have their characteristics 734 changed so that their prominence is diminished with respect to that particular sound object 710 during the pre-transitional phase 711.

The post-transitional phase 712 of the second sound scene 702 may be used to arrange the sound objects 710 of the second sound scene 702 in positions 710 and/or with characteristics 734 that reduce the abruptness of the transition 527 between the first sound scene 701 and the second sound scene 702.

It will be appreciated that different ones of the sound objects 710 in the second set 722 of sound objects will experience different adaptations when a comparison is made between the second sound scene 702 and the adapted second sound scene 702'. For example, some sound objects 710 may be moved a significant distance whereas other sound objects may be moved a smaller distance or not moved at all. For example, the characteristics 734 of some sound objects 710 may be changed whereas the characteristics 734 of other sound objects 710 may not be changed. For example, a particular sound object 710 may not have its position 730 changed and may not have its characteristics 734 changed whereas at least some of the other sound objects 710 may have their positions 730 changed so that they are closer to that particular sound object 710 during the post-transitional phase 712 and have their characteristics 734 changed so that their prominence is diminished with respect to that particular sound object 710 during the post-transitional phase 712.

In the example of FIGS. 13A and 13B, only the position and/or volume characteristics 734 of a sound object is changed between the first sound scene 701 and the adapted sound scene 701'. In other examples it may be possible to only change the position of a sound object 710 and not to change the volume characteristic 734 of the sound object or any of the sound objects.

In the example of FIGS. 13C and 13D, only the position and/or volume characteristics 734 of a sound object is changed between the second sound scene 702 and the adapted second sound scene 702'. In other examples it may be possible to only change the position of a sound object 710 and not to change the volume characteristic 734 of the sound object or any of the sound objects.

Comparing FIGS. 13A and 13B, it will be appreciated that spatial separation (S1) of the first set 721 of sound objects 710 in the first sound scene 701 defined by the first set 731 of respective positions 730 of the first set 721 of sound objects 710 is greater than the spatial separation (S1') of the first set 721 of sound objects 710 in the adapted first sound scene 701' based upon the adapted first set 731' of respective positions 730 of the first set 721 of sound objects 710 in the adapted first sound scene 701'. Consequently, the spatial separation of the first set 721 of sound objects 710 in the first sound scene 701 is reduced in the pre-transitional phase 711 compared to immediately before the pre-transitional phase 711.

Spatial separation may for example be calculated as the average distance between each pair of sound objects 710 or the average distance between the sound objects 710 and a defined sound object 710 or a defined position.

Comparing FIGS. 13C and 13D, it will be appreciated that the spatial separation (S2) of the second set 722 of sound objects 710 in the second sound scene 702 defined by the second set 732 of respective positions 730 of the second set 722 of sound objects 710 is greater than the spatial separation (S2') of the second set 722 of sound objects 710 in the adapted second sound scene 702' based upon the adapted second set 732' of respective positions 730 of the second set 722 of sound objects 710 in the adapted second sound scene 702'. Consequently, spatial separation of the second set 722 of sound objects 710 in the second sound scene 702 is reduced in the post-transitional phase 712 compared to immediately after the post-transitional phase 712.

Comparing FIGS. 13B and 13C, it will be appreciated that the spatial separation (S1') of the first set 721 of sound objects 710 in the adapted first sound scene 701' based upon the adapted first set 731' of respective positions 730 of the first set 721 of sound objects 710 in the adapted first sound scene 701' is similar to the spatial separation (S2') of the second set 722 of sound objects 710 in the adapted second sound scene 702' based upon the adapted second set 732' of respective positions 730 of the second set 722 of sound objects 710 in the adapted second sound scene 702'.

A difference (S1'−S2') in a spatial separation (S1') of the first set 721 of sound objects 710 in the pre-transitional phase 711 compared to a spatial separation (S2') of the second set 722 of sound objects 710 in the post-transitional phase 712 is significantly less than a difference (S1−S1) in a spatial separation (S1) of the first set 721 of sound objects immediately before the pre-transitional phase 711 and a spatial separation (S2) of the second set 722 of sound objects immediately after the post-transitional phase 712. For example, (S1'−S2')<0.5*(S1−S1).

FIGS. 14A to 14D, 15A to 15C and 16A to 16C illustrate examples of the method 520 similar to that illustrated in FIGS. 13A to 13D. For the sake of clarity of description, similar reference numerals have been used in these figures to reference similar features and these features will not be described in detail. The description that has previously been given in relation to these features is therefore also relevant in respect of the features of these figures. The description will focus on differences between the implementation illustrated in these figures and that illustrated in FIGS. 13A to 13D.

In each of FIGS. 14A to 14D, 15A to 15D and 16A to 16C, the method 520 further comprises selection of a first sound object 751 in the first set 721 of sound objects 710. The changing of the positions 730 of at least some of the first set 721 of sound objects 710 to create the adapted first sound scene 701' involves changing the positions 730 of at least some of the first set 721 of sound objects 710 relative to the selected first sound object 751.

The method 520 further comprises selection of a second sound object 752 in the second set 722 of sound objects 710. Changing the positions 730 of at least some of the second set 722 of sound objects 710 to change from the adapted second sound scene 702' to the second sound scene 702 involves changing the position 730 of at least some of the second set 722 of sound objects 710 relative to the selected second sound object 752.

The method 520 comprises automatically selecting the first sound object 751 and/or the second sound object 752 based upon one or more of the following criteria:

(i) the first sound object 751 and/or the second sound object 752 is for a solo performance;

(ii) the first sound object 751 is prominent with respect to position and/or volume within the first sound scene 701 and/or the second sound object 752 is prominent with respect to position and/or volume within the second sound scene 702. The prominence of position may be determined by a smaller distance from a central location of the sound scene or some other defined location within the sound scene, for example a position to which the user's attention is directed. The prominence of volume may be determined with respect to an absolute volume threshold or a relative volume comparison between sound objects 710 within the sound scene. The volume may be the instantaneous volume or an integrated (e.g. averaged) measure of the volume.

(iii) the first sound object 751 and the second sound object 752 are musically similar. This may be determined by tonal (frequency) comparison and/or tempo comparison.

(iv) the first sound object is the subject of user attention. This may be determined by tracking the movement of a user's head or gaze for example.

(v) the first sound object 751 and the second sound object 752 are in respect of the same sound source. The first whereas the second sound object 751 may be for the sound source from one location/perspective whereas the second sound object 752 may be for the sound source from a different location/perspective.

(vi) the first sound object 751 and the second sound object 752 occupy similar positions within the respective first sound scene and the second sound scene. This may for example be determined by determining a distance form a center of a respective sound scene.

(vii) the first sound object and the second sound object have similar volumes or relative volumes within the respective first sound scene 701 and the second sound scene 702.

For the sake of convenience, in FIGS. 14A to 14D, similar figures have been used where possible. FIG. 14A is the same as FIG. 13A, and FIG. 14D is the same as FIG. 13D. Furthermore FIG. 14B is similar to FIG. 13B and FIG. 14C is similar to FIG. 13C.

The difference between the adapted first sound scene 701' illustrated in FIG. 14B and that illustrated in FIG. 13B is that all of the operative sound objects 710 are positioned in the adapted first sound scene 701' within a threshold distance D1 of a selected one (first sound object 751) of the first set 721 of sound objects 710. Changing the positions 730 of at least some of the first set 721 of the sound objects 710 on entering the pre-transitional phase 711 involves moving at least some of the first set 721 of sound objects 710 to within a pre-determined first distance D1 of the selected first sound object 751. This reduces spatial separation.

The difference between the adapted second sound scene 702' illustrated in FIG. 14C and that illustrated in FIG. 13C is that all of the operative sound objects 710 are positioned in the adapted second sound scene 702' within a threshold distance D2 of a selected one (second sound object 752) of the second set 722 of sound objects 710. Changing the positions 730 of at least some of the second set 722 of sound objects 710 on leaving the post-transitional phase 712 involves moving the at least some of the second set 722 of sound objects 710 from within a second pre-determined distance D2 of the selected second sound object 752. This increases spatial separation.

FIGS. 15A-15C and FIGS. 16A-16C illustrate in more detail possible transitions 527 between the pre-transitional first sound scene 701' and the post-transitional second sound scene 702'.

In these examples, a mapping is defined between at least some of the first set 721 of sound objects 710 and at least some of the second set 722 of sound objects 710 to define mapped pairs of sound objects. Each mapped pair comprises a sound object of the first set 721 and a sound object of the second set 722.

The method 520 causes positional matching between the sound objects 710 in the respective mapped pairs of sound objects before and after the transition 527 between the first sound scene 701 in the pre-transitional phase 711 and the second sound scene 702 in the post-transitional phase 712.

Figure 15A:
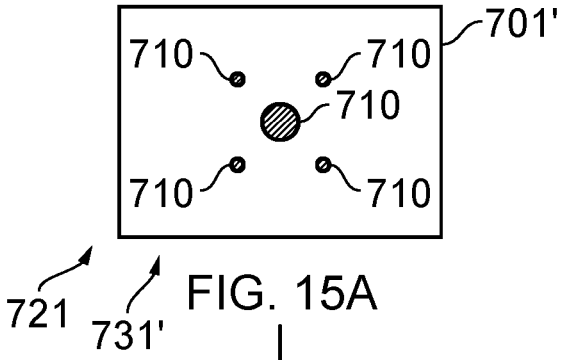
FIGS. 15A-15C illustrate an example of a two-stage post-transitional phase of the second sound scene.
Figure 15B:
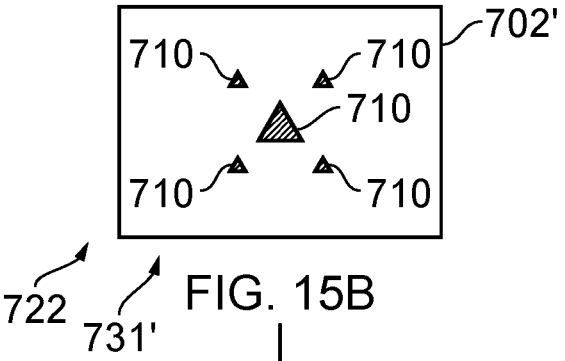
Figure 15C:
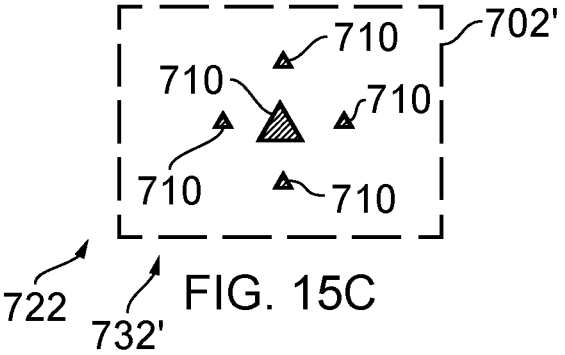

In FIGS. 15A, 15B, 15C the positional matching between the sound objects 710 in the respective mapped pairs of sound objects before and after the transition 527 is achieved by positioning the mapped sound objects 710 in the adapted second sound scene 702' so that they have an arrangement similar to that of the mapped sound objects in the adapted first sound scene 701'. For example, the constellation of the mapped sound objects in the adapted second sound scene 702' have been rotated or otherwise adapted to be similar to the constellation of the mapped sound objects 710 in the adapted first sound scene 701'. The constellation may for example be calculated as the angular separation between each pair of sound objects 710 or the sum of vectors defining the positions 730 of the sound objects 710 relative to a defined sound object 710 or a defined position. In some but not necessarily all examples, this may be achieved by using the first adapted set 731' of positions 730 of the mapped sound objects in the first sound scene 701 as the second adapted set 732' of positions 730 for the mapped sound objects in the adapted second sound scene 702' in the post-transitional phase 712.

Optionally the adapted second set 732' of positions 730 for the mapped sound objects in the adapted second sound scene 702' is modified during the post-transitional phase 712. This may comprise positioning the mapped sound objects in the adapted second sound scene 702' so that they have an arrangement more similar to that of the mapped sound objects in the second sound scene 702. For example, the constellation of the mapped sound objects in the adapted second sound scene 702' may be rotated or adapted to be similar to the constellation of the mapped sound objects in the second sound scene 702.

Thus the transition from the first sound scene 701 to the second sound scene may comprise:

(a) in the pre-transitional phase, a spatial compression of the sound objects of the first sound scene to create an adapted first sound scene 701' (FIG. 14A-14B);

(b) a transition from the adapted first sound scene 701 to an adapted second sound scene 702' with a constellation of sound objects similar to the constellation of sound objects in the adapted first sound scene 701' (FIGS. 15A-15B);

(c) in the post-transitional phase, a change in the constellation of the sound objects in the adapted second sound scene 702 to a new constellation (FIG. 15B-15C); and (d) a spatial decompression of the sound objects in the adapted second sound scene 702' with the new constellation (FIGS. 14C-14D).

The spatial compression step (a) may be optional. The re-arrangement step (b) may be optional. The re-arrangement step (c) may be optional. The spatial compression step (d) may be optional.

Figure 16A:
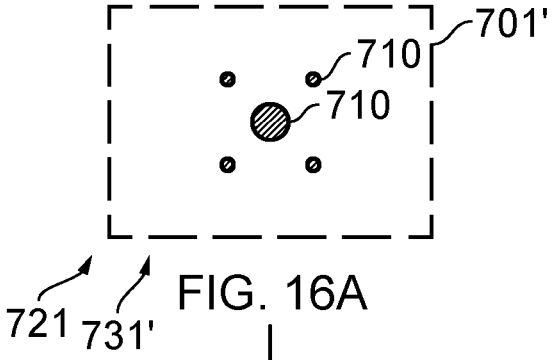
FIGS. 16A-16C illustrate an example of a two-stage pre-transitional phase of the first sound scene.
Figure 16B:
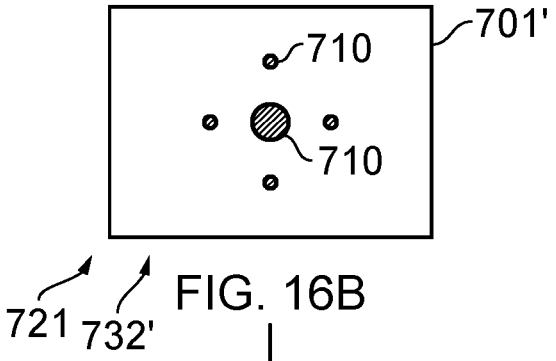
Figure 16C:
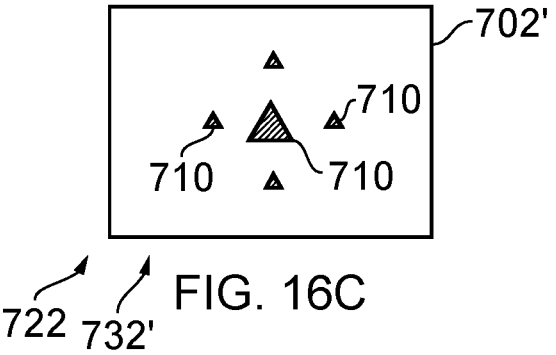

In FIGS. 16A, 16B, 16C the positional matching between the sound objects 710 in the respective mapped pairs of sound objects before and after the transition 527 is achieved by positioning the mapped sound objects 710 in the adapted first sound scene 702' so that they have an arrangement similar to that of the mapped sound objects in the adapted second sound scene 702'. The adapted first set 731' of positions 730 for the mapped sound objects in the adapted first sound scene 702' is modified during the post-transitional phase 712. This may comprise positioning the mapped sound objects in the adapted first scene 701' so that they have an arrangement more similar to that of the mapped sound objects in the second sound scene 702.

For example, the constellation of the mapped sound objects in the adapted first sound scene 701' have been rotated or otherwise adapted during the pre-transitional phase to be similar to the constellation of the mapped sound objects 710 in the adapted second sound scene 702'. The constellation may for example be calculated as the angular separation between each pair of sound objects 710 or the sum of vectors defining the positions 730 of the sound objects 710 relative to a defined sound object 710 or a defined position. In some but not necessarily all examples, this may be achieved by using the second adapted set 732' of positions 730 of the mapped sound objects in the first sound scene 701 as an updated first adapted set 731' of positions 730 for the mapped sound objects in the adapted first sound scene 701' in the pre-transitional phase 711.

Thus the transition from the first sound scene 701 to the second sound scene may comprise:

(a) in the pre-transitional phase, a spatial compression of the sound objects of the first sound scene to create an adapted first sound scene 701' (FIG. 14A-14B);

(b) in the pre-transitional phase, a change in the constellation of the sound objects in the adapted first sound scene 701' to a new constellation (FIG. 16AB-16B); and (c) a transition from the adapted first sound scene 701' to an adapted second sound scene 702' with a constellation of sound objects similar to the constellation of sound objects in the adapted first sound scene 701' (FIGS. 16B-16C);

(d) a spatial decompression of the sound objects in the adapted second sound scene 702' with the new constellation (FIGS. 14C-14D).

The spatial compression step (a) may be optional. The re-arrangement step (b) may be optional. The re-arrangement step (c) may be optional. The spatial compression step (d) may be optional.

Figure 17A:
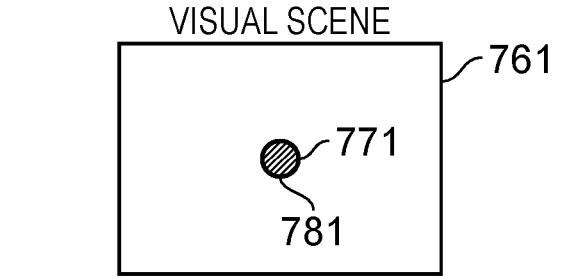
FIGS. 17A and 17B illustrate an example of a visual scene before the transition (FIG. 17A) and after the transition (FIG. 17B).
Figure 17B:
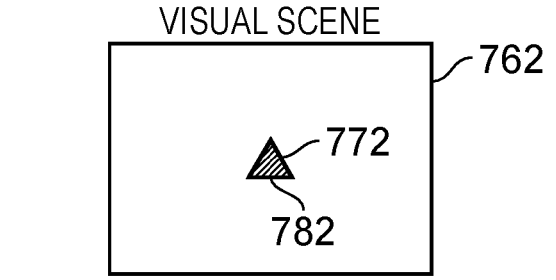

FIGS. 17A and 17B illustrate an example of a visual scene before the transition 527 (FIG. 17A) and after the transition (FIG. 17B).

In this example, the method 520 additionally comprises automatically causing rendering of a first visual scene 761 corresponding to the first sound scene 701 before the transition 527 of the first sound scene 701 to the second sound scene 702 and rendering of a second visual scene 762 corresponding to the second sound scene 702 after the transition 527 of the first sound scene 701 to the second sound scene 702.

In FIG. 17A, a first visual object 771 in the first visual scene 761 is at a first position 781 within the first visual scene 761.

In FIG. 17B, a second visual object 772 in the second visual scene 762 is at a second position 782 within the second visual scene 762.

The first position 761 and the second position 762 are the same such that a visual matching cut is performed. That when the visual transition occurs between the first visual scene 761 and the second visual scene 762, the first visual object 771 and the second visual object 772 appear at the same location within the different scenes.

In some but not necessarily all examples, the first visual scene 761 corresponds to the first sound scene 701 and the first visual object 771 corresponds to a sound object 710, for example the selected first sound object 751.

In some but not necessarily all examples, the second visual scene 762 corresponds to the second sound scene 702 and the second visual object 772 corresponds to a sound object 710, for example the selected second sound object 752.

The first visual scene 761 and the second visual scene 762 may be virtual visual scene 22 and the first visual object 771 and the second visual object 772 may be virtual visual objects 21.

In the examples previously illustrated it will be appreciated that the first adapted sound scene 701' comprises exclusive only sound objects 710 that were in the first sound scene 701. It may comprise the same sound objects 710 or less sound objects 710. However, in other examples, the first adapted sound scene 701' may additionally comprise one or more sound objects 710 that are in the second sound scene 702.

In the examples previously illustrated it will be appreciated that the second adapted sound scene 702' comprises exclusive only sound objects 710 that are in the second sound scene 702. It may comprise the same sound objects 710 or less sound objects 710. However, in other examples, the second adapted sound scene 702' may additionally comprise one or more sound objects 710 that are in the first sound scene 702.

In the examples previously illustrated it will be appreciated that the first sound scene has a pre-transitional phase (the first adapted sound scene 701') and the second sound scene 702 has a post-transitional phase (a second adapted sound scene 702'). In these examples, the pre-transitional phase and the post-transitional phase are distinct because the pre-transitional phase and the post-transitional phase comprise different sound objects. The pre-transitional phase comprises only sound objects 710 of the first sound scene 701 and the post-transitional phase comprises only sound objects of the second sound scene 702. However, in other examples, a single intermediate (transitional) sound scene may be provided in both the pre-transitional phase and the post-transitional phase. This single (intermediate) sound scene may, for example, comprise only sound objects from the first sound scene 701, only sound objects from the second sound scene 702 or sound objects from both the first sound scene 701 and the second sound scene 702.

According to various, but not necessarily all, examples the method 520 may comprise: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising at least some of the first set of sound objects at a first adapted set of respective positions different to the first set of respective positions and/or at least some of the second set of sound objects at a second adapted set of respective positions different to the second set of respective positions.

According to various, but not necessarily all, examples the method 520 may comprise: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising at least some of the first set of sound objects at a first adapted set of respective positions different to the first set of respective positions and comprising none of the second set of sound objects.

According to various, but not necessarily all, examples the method 520 may comprise: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions by creating at least one intermediary sound scene comprising at least some of the second set of sound objects at a second adapted set of respective positions different to the second set of respective positions and comprising none of the first set of sound objects.

In the foregoing examples, reference has been made to a computer program or computer programs. A computer program, for example either of the computer programs 48, 416 or a combination of the computer programs 48, 416 may be configured to perform the method 520.

Also as an example, an apparatus 30, 400 may comprises: at least one processor 40, 412; and at least one memory 46, 414 including computer program code the at least one memory 46, 414 and the computer program code configured to, with the at least one processor 40, 412, cause the apparatus 430, 00 at least to perform: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions, by:

- causing rendering of the first sound scene comprising the first set of sound objects at the first set of respective positions; then
- causing changing of the respective positions of at least some of the first set of sound objects to render the first sound scene in a pre-transitional phase as an adapted first sound scene comprising the first set of sound objects at a first adapted set of respective positions different to the first set of respective positions; then
- causing rendering of the second sound scene in a post-transitional phase as an adapted second sound scene comprising the second set of sound objects at a second adapted set of respective positions different to the second set of respective positions; then causing a changing of the respective positions of at least some of the second set of sound objects to render the second sound scene as the second set of sound objects at the second set of respective positions.

Also as an example, an apparatus 30, 400 may comprises: at least one processor 40, 412; and at least one memory 46, 414 including computer program code the at least one memory 46, 414 and the computer program code configured to, with the at least one processor 40, 412, cause the apparatus 430, 00 at least to perform: causing rendering of sound scenes comprising sound objects at respective positions; automatically controlling transition of a first sound scene, comprising a first set of sound objects at a first set of respective positions, to a second sound scene, different to the first sound scene and comprising a second set of sound objects at a second set of respective positions, by:

causing rendering of the first sound scene comprising the first set of sound objects at the first set of respective positions; then causing changing of the respective positions of at least some of the first set of sound objects to render the first sound scene in a pre-transitional phase as an adapted first sound scene comprising the first set of sound objects at a first adapted set of respective positions different to the first set of respective positions; then causing rendering of the second sound scene in a post-transitional phase as an adapted second sound scene comprising the second set of sound objects at a second adapted set of respective positions different to the second set of respective positions; then causing a changing of the respective positions of at least some of the second set of sound objects to render the second sound scene as the second set of sound objects at the second set of respective positions.

The computer program 48, 416 may arrive at the apparatus 30,400 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 48, 416. The delivery mechanism may be a signal configured to reliably transfer the computer program 48, 416. The apparatus 30, 400 may propagate or transmit the computer program 48, 416 as a computer data signal. FIG. 10 illustrates a delivery mechanism 430 for a computer program 416.

It will be appreciated from the foregoing that the various methods 520 described may be performed by an apparatus 30, 400, for example an electronic apparatus 30, 400.

The electronic apparatus 400 may in some examples be a part of an audio output device 300 such as a head-mounted audio output device or a module for such an audio output device 300. The electronic apparatus 400 may in some examples additionally or alternatively be a part of a head-mounted apparatus 33 comprising the display 32 that displays images to a user.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks, steps and processes illustrated in the FIGS. 11-17B may represent steps in a method and/or sections of code in the computer program. The illustration of a particular order to the blocks does not necessarily imply that there is a required or preferred order for the blocks and the order and arrangement of the block may be varied. Furthermore, it may be possible for some blocks to be omitted.

Where a structural feature has been described, it may be replaced by means for performing one or more of the functions of the structural feature whether that function or those functions are explicitly or implicitly described.

As used here 'module' refers to a unit or apparatus that excludes certain parts/components that would be added by an end manufacturer or a user. The controller 42 or controller 410 may, for example be a module. The apparatus may be a module. The display 32 may be a module.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed. For example, although embodiments of the invention are described above in which multiple video cameras 510 simultaneously capture live video images 514, in other embodiments it may be that merely a single video camera is used to capture live video images, possibly in conjunction with a depth sensor.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

at least one processor; and at least one memory including computer program code, the at least one memory and the computer program code configured to, with the at least one processor, cause the apparatus to perform at least the following:

cause rendering of sound scenes comprising sound objects at respective positions;

control transition of a first sound scene, comprising a first set of sound objects at a first set of respective positions, to a second sound scene, different to the first sound scene and comprising a second set of sound objects at a second set of respective positions, by:

cause rendering of the first sound scene comprising the first set of sound objects at the first set of respective positions;

select at least one first sound object in the first set of sound objects;

cause changing of the respective positions of at least some of the first set of sound objects relative to the at least one first sound object to render the first sound scene in a pre-transitional phase as an adapted first sound scene comprising the first set of sound objects at a first adapted set of respective positions different to the first set of respective positions and to reduce a spatial separation of the first set of sound objects in the pre-transitional phase defined by the first adapted set of positions relative to the spatial separation of the first set of sound objects in the first sound scene;

select at least one second sound object in the second set of sound objects;

cause rendering of the second sound scene in a post-transitional phase as an adapted second sound scene comprising the second set of sound objects at a second adapted set of respective positions different to the second set of respective positions;

cause changing of the respective positions of at least some of the second set of sound objects relative to the at least one second sound object to render the second sound scene as the second set of sound objects at the second set of respective positions and to reduce a spatial separation of the second set of sound objects in the post-transitional phase defined by the second adapted set of positions relative to the spatial separation of the second set of sound objects in the second sound scene.

2. An apparatus as claimed in claim 1, further cause the apparatus to perform at least the following:

change the positions of at least some of the first set of sound objects by performing at least one of moving the at least some of the first set of sound objects to within a first predetermined distance of the selected first sound object, or changing the positions of at least some of the second set of sound objects by moving the at least some of the second set of sound objects to within a second predetermined distance of the selected second sound object.

3. An apparatus as claimed in claim 1, wherein at least one of the first sound object or the second sound object is selected based upon one or more of the following criteria:

at least one of the first sound object or the second sound object is for a solo performance;

the first sound object is prominent with respect to at least one of a position or a volume within the first sound scene;

the second sound object is prominent with respect to at least one of a position or a volume within the second sound scene;

the first sound object and the second sound object are musically similar;

the first sound object is the subject of user attention;

the first sound object and the second sound object are in respect of the same sound source;

the first sound object and the second sound object occupy similar positions within the respective first sound scene and the second sound scene; or the first sound object and the second sound object have similar volumes or relative volumes within the respective first sound scene and the second sound scene.

4. An apparatus as claimed in claim 1, wherein controlling transition of the first sound scene to the second sound scene in response to direct or indirect user specification of a change in sound scene from the first sound scene to the second sound scene.

5. An apparatus as claimed in claim 1, wherein at least one of: (a) the pre-transitional phase of the first sound scene differs from the first sound scene before the pre-transitional phase in that the position or position and volume of at least some of the first sound objects is different between the first sound scene, immediately before the pre-transitional phase, and the pre-transitional phase of the first sound scene; or (b) the post-transitional phase of the second sound scene differs from the second sound scene after the post-transitional phase in that the position or position and volume of at least some of the second sound objects is different between the second sound scene, immediately after the post-transitional phase, and the post-transitional phase of the second sound scene.

6. An apparatus as claimed in claim 1, wherein at least one of: (a) the change in positions of at least some of the first set of sound objects to render the first sound scene in the pre-transitional phase comprises different changes in positions to different ones of the at least some of the first set of sound objects; or (b) changing the positions of at least some of the second set of sound objects to render the second sound scene in a post-transitional phase as an adapted second sound scene comprises applying different changes in positions to different ones of the at least some of the second set of sound objects.

7. An apparatus as claimed in claim 1, wherein at least one of: (a) the pre-transitional phase of the first sound scene differs from the first sound scene before the pre-transitional phase not only with respect to one or more changes in positions of at least some of the first set of sound objects but also in respect of one or more changes in one or more additional characteristics of at least some of the first set of sound objects, or (b) the post-transitional phase of the second sound scene differs from the second sound scene after the post-transitional phase not only with respect to one or more changes in positions of at least some of the second set of sound objects but also in respect of one or more changes in one or more additional characteristics of at least some of the second set of sound objects.

8. An apparatus as claimed in claim 1, wherein at least one of: (a) changing the positions of at least some of the first set of sound objects to render the first sound scene in a pre-transitional phase as an adapted first sound scene comprises applying different changes in positions and also different changes in an additional characteristic of a sound object to at least some of the first set of sound objects, or (b) changing the positions of at least some of the second set of sound objects to render the second sound scene in a post-transitional phase as an adapted second sound scene comprises applying different changes in positions and also different changes in an additional characteristic of a sound object to at least some of the second set of sound objects.

9. An apparatus as claimed in claim 1, wherein a difference in a spatial separation of the first set of sound objects in the pre-transitional phase compared to a spatial separation of the second set of sound objects in the post-transitional phase is significantly less than a difference in a spatial separation of the first set of sound objects immediately before the pre-transitional phase and a spatial separation of the second set of sound objects immediately after the post-transitional phase.

10. An apparatus as claimed in claim 1, further cause the apparatus to perform at least the following:

define a mapping between at least some of the first set of sound objects and at least some of the second set of sound objects to define mapped pairs of sound objects, each mapped pair comprising a sound object of the first set and a sound object of the second set, and causing positional matching between the sound objects in the respective mapped pairs of sound objects before and after the transition between the first sound scene in the pre-transitional phase and the second sound scene in the post-transitional phase.

11. An apparatus as claimed in claim 1, further cause the apparatus to perform at least the following:

cause rendering of a first visual scene corresponding to the first sound scene before the transition of the first sound scene to the second sound scene and rendering of a second visual scene corresponding to the second sound scene after the transition of the first sound scene to the second sound scene, wherein a first visual object in the first visual scene is at a first position within the first visual scene and a second visual object in the second visual scene is at a second position within the second visual scene and wherein the first position and the second position are the same such that a visual matching cut is performed.

12. A method comprising:

causing rendering of sound scenes comprising sound objects at respective positions;

controlling transition of a first sound scene, comprising a first set of sound objects at a first set of respective positions, to a second sound scene, different to the first sound scene and comprising a second set of sound objects at a second set of respective positions, by:

causing rendering of the first sound scene comprising the first set of sound objects at the first set of respective positions;

selecting at least one first sound object in the first set of sound objects;

causing changing of the respective positions of at least some of the first set of sound objects relative to the at least one first sound object to render the first sound scene in a pre-transitional phase as an adapted first sound scene comprising the first set of sound objects at a first adapted set of respective positions different to the first set of respective positions and to reduce a spatial separation of the sound objects in the pre-transitional phase defined by the first adapted set of positions relative to the spatial separation of the sound objects in the first sound scene;

selecting at least one second sound object in the second set of sound objects;

causing rendering of the second sound scene in a post-transitional phase as an adapted second sound scene comprising the second set of sound objects at a second adapted set of respective positions different to the second set of respective positions;

causing a changing of the respective positions of at least some of the second set of sound objects relative to the at least one second sound object to render the second sound scene as the second set of sound objects at the second set of respective positions and to reduce a spatial separation of the sound objects in the post-transitional phase defined by the second adapted set of positions relative to the spatial separation of the sound objects in the second sound scene.

13. A method as claimed in claim 12, further comprising changing the positions of at least some of the first set of sound objects by performing at least one of moving the at least some of the first set of sound objects to within a first predetermined distance of the selected first sound object or changing the positions of at least some of the second set of sound objects by moving the at least some of the second set of sound objects to within a second predetermined distance of the selected second sound object.

14. A method as claimed in claim 12, wherein at least one of the first sound object or the second sound object is selected based upon one or more of the following criteria:

at least one of the first sound object or the second sound object is for a solo performance;

the first sound object is prominent with respect to at least one of a position or a volume within the first sound scene;

the second sound object is prominent with respect to at least one of a position or a volume within the second sound scene;

the first sound object and the second sound object are musically similar;

the first sound object is the subject of user attention;

the first sound object and the second sound object are in respect of the same sound source;

the first sound object and the second sound object occupy similar positions within the respective first sound scene and the second sound scene; or the first sound object and the second sound object have similar volumes or relative volumes within the respective first sound scene and the second sound scene.

15. A method as claimed in claim 12, wherein controlling transition of the first sound scene to the second sound scene in response to direct or indirect user specification of a change in sound scene from the first sound scene to the second sound scene.

16. A method as claimed in claim 12, wherein at least one of (a) the pre-transitional phase of the first sound scene differs from the first sound scene before the pre-transitional phase only in that the position or position and volume of at least some of the first sound objects is different between the first sound scene, immediately before the pre-transitional phase, and the pre-transitional phase of the first sound scene; or (b) the post-transitional phase of the second sound scene differs from the second sound scene after the post-transitional phase only in that the position or position and volume of at least some of the second sound objects is different between the second sound scene, immediately after the post-transitional phase, and the post-transitional phase of the second sound scene.

17. A method as claimed in claim 12, wherein at least one of (a) the change in positions of at least some of the first set of sound objects to render the first sound scene in the pre-transitional phase comprises different changes in positions to different ones of the at least some of the first set of sound objects, or (b) changing the positions of at least some of the second set of sound objects to render the second sound scene in a post-transitional phase as an adapted second sound scene comprises applying different changes in positions to different ones of the at least some of the second set of sound objects.

18. A method as claimed in claim 12, wherein at least one of (a) the pre-transitional phase of the first sound scene differs from the first sound scene before the pre-transitional phase not only with respect to one or more changes in positions of at least some of the first set of sound objects but also in respect of one or more changes in one or more additional characteristics of at least some of the first set of sound objects, or (b) the post-transitional phase of the second sound scene differs from the second sound scene after the post-transitional phase not only with respect to one or more changes in positions of at least some of the second set of sound objects but also in respect of one or more changes in one or more additional characteristics of at least some of the second set of sound objects.

19. A non-transitory computer readable medium comprising program instructions stored thereon for performing at least the following:

cause rendering of sound scenes comprising sound objects at respective positions;

control transition of a first sound scene, comprising a first set of sound objects at a first set of respective positions, to a second sound scene, different to the first sound scene and comprising a second set of sound objects at a second set of respective positions, by:

cause rendering of the first sound scene comprising the first set of sound objects at the first set of respective positions;

select at least one first sound object in the first set of sound objects;

cause changing of the respective positions of at least some of the first set of sound objects relative to the at least one first sound object to render the first sound scene in a pre-transitional phase as an adapted first sound scene comprising the first set of sound objects at a first adapted set of respective positions different to the first set of respective positions and to reduce a spatial separation of the sound objects in the pre-transitional phase defined by the first adapted set of positions relative to the spatial separation of the sound objects in the first sound scene;

select at least one second sound object in the second set of sound objects;

cause rendering of the second sound scene in a post-transitional phase as an adapted second sound scene comprising the second set of sound objects at a second adapted set of respective positions different to the second set of respective positions;

cause changing of the respective positions of at least some of the second set of sound objects relative to the at least one second sound object to render the second sound scene as the second set of sound objects at the second set of respective positions and to reduce a spatial separation of the sound objects in the post-transitional phase defined by the second adapted set of positions relative to the spatial separation of the sound objects in the second sound scene.

* * * * *